US009389529B2

(12) United States Patent
Hirai et al.

(10) Patent No.: US 9,389,529 B2
(45) Date of Patent: Jul. 12, 2016

(54) BRILLIANT TONER AND ELECTROSTATIC CHARGE IMAGE DEVELOPER

(71) Applicant: FUJI XEROX CO., LTD., Tokyo (JP)

(72) Inventors: Sakiko Hirai, Kanagawa (JP); Atsushi Sugitate, Kanagawa (JP); Masaru Takahashi, Kanagawa (JP); Shotaro Takahashi, Kanagawa (JP); Satomi Hara, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/604,045

(22) Filed: Jan. 23, 2015

(65) Prior Publication Data

US 2016/0085169 A1 Mar. 24, 2016

(30) Foreign Application Priority Data

Sep. 24, 2014 (JP) ..... 2014-194314

(51) Int. Cl.
*G03G 9/093* (2006.01)
*G03G 9/09* (2006.01)
*G03G 9/087* (2006.01)

(52) U.S. Cl.
CPC ..... *G03G 9/0924* (2013.01); *G03G 9/08742* (2013.01); *G03G 9/091* (2013.01); *G03G 9/092* (2013.01)

(58) Field of Classification Search
CPC ..... G03G 9/0902
See application file for complete search history.

(56) References Cited

U.S. PATENT DOCUMENTS

2011/0318063 A1* 12/2011 Takahashi ..... G03G 9/0819 399/262
2011/0318682 A1 12/2011 Takahashi et al.
2011/0318683 A1* 12/2011 Kadokura ..... G03G 9/0819 430/105
2014/0234765 A1* 8/2014 Hirai ..... G03G 15/0865 430/105
2015/0064615 A1* 3/2015 Hirai ..... G03G 9/0827 430/105
2016/0011533 A1* 1/2016 Hara ..... G03G 9/09342 430/105

FOREIGN PATENT DOCUMENTS

JP S62-067558 A 3/1987
JP S62-100769 A 5/1987
JP 2012-032765 A 2/2012
JP 2012-163695 A 8/2012

* cited by examiner

*Primary Examiner* — Hoa V Le
(74) *Attorney, Agent, or Firm* — Oliff PLC

(57) ABSTRACT

A brilliant toner includes a brilliant pigment, an azo yellow pigment, and a magenta pigment, wherein when a solid image in which a toner applied amount is 4.0 g/m$^2$ is formed, color saturation of the image is 25 to 55, a hue angle is 65° to 95°, and lightness is 50 to 80.

17 Claims, 3 Drawing Sheets

BRILLIANT TONER AND ELECTROSTATIC CHARGE IMAGE DEVELOPER

CROSS-REFERENCE TO RELATED APPLICATIONS

This application is based on and claims priority under 35 USC 119 from Japanese Patent Application No. 2014-194314 filed Sep. 24, 2014.

BACKGROUND

1. Technical Field

The present invention relates to a brilliant toner and an electrostatic charge image developer.

2. Related Art

Methods of visualizing image information via an electrostatic image such as an electrophotographic method are currently used in various fields.

In the electrophotographic method of the related art, a method of visualizing image information through plural processes of forming an electrostatic latent image on a photoreceptor or an electrostatic recording medium by using various methods, attaching voltage detecting particles called "toner" to the electrostatic latent image and developing the electrostatic latent image (toner image), transferring the image onto a surface of a transfer medium, and fixing the image by heating or the like is generally used.

Among toners, for the purpose of forming an image having brilliance such as metallic gloss, a brilliant toner is used.

SUMMARY

According to an aspect of the invention, there is provided a brilliant toner including:

a brilliant pigment;

an azo yellow pigment; and a magenta pigment, wherein when a solid image in which a toner applied amount is 4.0 g/m$^2$ is formed, color saturation of the image is 25 to 55, a hue angle is 65° to 95°, and lightness is 50 to 80.

BRIEF DESCRIPTION OF THE DRAWINGS

Exemplary embodiments of the present invention will be described in detail based on the following figures, wherein.

DETAILED DESCRIPTION

Figure 1:
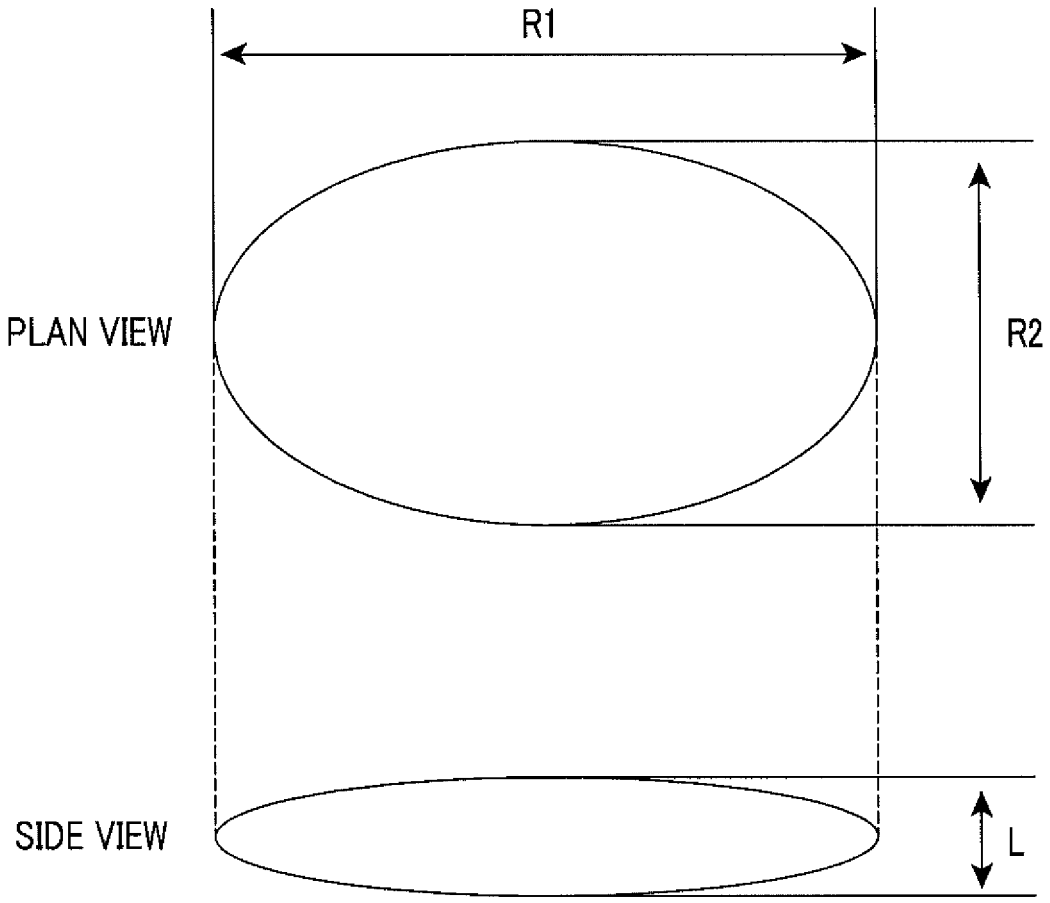
FIG. 1 is a plan view and a side view schematically showing an example of an electrostatic charge image developing toner according to an exemplary embodiment.

Hereinafter, exemplary embodiments will be described.

In the exemplary embodiments, the expression "A to B" is used to represent not only a range of A to B but also a range including A and B which are the end points. For example, when the expression "A to B" represents a numerical range, the expression "A to B" represents "A or more and B or less" or "B or more and A or less".

Brilliant Toner

A brilliant toner according to an exemplary embodiment (hereinafter, also simply referred to as a "toner") includes a brilliant pigment, an azo yellow pigment, and a magenta pigment, in which when a solid image in which a toner applied amount is 4.0 g/m$^2$ is formed, the color saturation of the image is 25 to 55, the hue angle is 65° to 95°, and the lightness is 50 to 80.

In addition, a brilliant toner according to another exemplary embodiment includes a brilliant pigment, an azo yellow pigment, and a magenta pigment, in which a number average equivalent circular diameter of the brilliant pigment particles is 5 μm to 9 μm, a content of the brilliant pigment particles having an equivalent circular diameter of 4.0 μm or less with respect to a total number of the brilliant pigment particles is 20% by number or less, a total amount of the azo yellow pigment and the magenta pigment with respect to 100 parts by weight of the brilliant pigment is 15 parts by weight to 50 parts by weight, and a weight ratio of the azo yellow pigment and the magenta pigment is 3:1 to 30:1.

In the exemplary embodiment, the term "brilliant" refers to brilliance such as metallic gloss when an image formed with a toner is visually recognized.

Since a colorant-containing brilliant toner of the related art contains a large amount of a fine powder of a brilliant pigment, the orientation of the pigment in an image is in disarray. Then, the lightness is lowered and the color tone becomes dark and thus the color saturation is lowered. Therefore, when a color with high color saturation and lightness such as a fluorescent color is printed onto paper or a material to be printed, uneven color saturation and lightness occur in the image and thus a problem that a satisfactory golden image cannot be obtained arises. When the amount of a colored pigment is increased, the color saturation and lightness are increased but the brilliance is lowered. Thus, it is not easy to obtain color saturation and lightness and brilliance.

As a result of intensive studies, the present inventors have found that if a brilliant toner including a brilliant pigment, an azo yellow pigment, and a magenta pigment, in which when the solid image in which a toner applied amount is 4.0 g/m$^2$ is formed, the color saturation of the image is 25 to 55, the hue angle is 65° to 95°, and the lightness is 50 to 80, is used, uneven color saturation and lightness in the image is prevented and a satisfactory golden image may be obtained.

Also, as a result of intensive studies, the present inventors have found that if a brilliant toner including a brilliant pigment, an azo yellow pigment, and a magenta pigment, in which a number average equivalent circular diameter of the brilliant pigment particles is 5 μm to 9 μm, a content of the brilliant pigment particles having an equivalent circular diameter of 4.0 μm or less with respect to a total number of the brilliant pigment particles is 20% by number or less, a total amount of the azo yellow pigment and the magenta pigment with respect to 100 parts by weight of the brilliant pigment is 15 parts by weight to 50 parts by weight, and a weight ratio of the azo yellow pigment and the magenta pigment is 3:1 to 30:1, is used, uneven color saturation and lightness in the image is prevented and a satisfactory golden image may be obtained.

Hereinafter, each component constituting the toner and the physical properties thereof will be described in detail.

Brilliant Pigment

A brilliant toner according to an exemplary embodiment contains a brilliant pigment.

As the brilliant pigment, a metal pigment, a pearl-like pigment, and the like may be used.

Examples of the brilliant pigment include, but are not particularly limited to, as long as the pigment particles have brilliance, metal powders, such as aluminum, brass, bronze, nickel, stainless steel, zinc, copper, silver, gold, and platinum, coated flaky inorganic crystal substrates such as mica, barium sulfate, a layer silicate and a layer aluminum silicate that are coated with titanium oxide or yellow iron oxide, single-crystal plate-shape titanium oxide, basic carbonate, bismuth oxychloride, natural guanine, flaky glass powder, and metal-deposited flaky glass powder. Among them, from the viewpoint of costs, stability, ease of availability, and brilliance, a metal pigment is preferable, an aluminum pigment is more preferable, and a metal pigment of an aluminum metal alone is particularly preferable.

Further, with respect to 100 parts by weight of the brilliant pigment, a total amount of the azo yellow pigment and the magenta pigment is 15 parts by weight to 50 parts by weight, and preferably 20 parts by weight to 40 parts by weight.

Circle Equivalent Diameter

The number average equivalent circular diameter of the brilliant pigment particles is 5 μm to 9 μm, preferably 5 μm to 8 μm, and more preferably 6 μm to 8 μm.

In addition, with respect to the total number of the brilliant pigment particles, a content of the brilliant pigment particles having a circle equivalent diameter of 4.0 μm or less is 20% by number or less, preferably 15% by number or less, and more preferably 12% by number.

The shape of the brilliant pigment is preferably a flake (plate) shape or a tabular shape, and is more preferably a flake shape. In addition, in the brilliant pigment, an average circle equivalent diameter of the metal pigment particles is preferably larger than the maximum average value of the brilliant pigment.

A flake-shape particle refers to a particle which has a substantially flat plane (X-Y plane) and a substantially uniform thickness (z). Here, the major axis on the plane of the flake-shape particle is defined as X, the minor axis is defined as Y, and the thickness is defined as Z. Further, the X-Y plane is a plane which has the maximum projection area.

The circle equivalent diameter is a diameter of a circle when a substantially flat plane (X-Y plane) of the tabular particle is assumed as a circle having the same projection area as the projection area of the particle. When the substantially flat plane (X-Y plane) of the tabular particle is a polygonal shape, a diameter of a circle obtained by converting the projection plane of the polygonal shape into a circle refers to a circle equivalent diameter of the tabular particle.

The circle equivalent diameter may be measured using a flow-type particle image analyzer FPIA-3000 (manufactured by Sysmex Corporation).

Fine Powder Removing Method

The circle equivalent diameter of the brilliant pigment particles may be adjusted by removing fine powder.

Examples of the method of removing fine powder include a method of repeating an operation of removing a supernatant by mixing the brilliant pigment, a surfactant, and water and allowing the mixture to naturally be settled for a predetermined period of time.

The surfactant is not particularly limited and known surfactants may be used. However, anionic surfactants are preferably used.

As the anionic surfactants, known anionic surfactants may be used without limitation but sulfonic acid salt compounds, carboxylate compounds, phosphoric acid ester salt compounds, or sulfuric acid ester salt compounds are preferable, and sulfonic acid salt compounds are more preferable.

The water is not particularly limited and ion exchange water may be suitably used.

In addition, with respect to 100 parts by weight of water, the content of the brilliant toner is preferably 5 parts by weight to 50 parts by weight, more preferably 10 parts by weight to 40 parts by weight, and even more preferably 15 parts by weight to 35 parts by weight.

The content of the surfactant is preferably 0.1 parts by weight to 3 parts by weight, more preferably 0.2 parts by weight to 2 parts by weight, and even more preferably 0.3 parts by weight to 1 part by weight with respect to 100 parts by weight of water.

A method of mixing each of the above components is not particularly limited but for example, a mixing method using an emulsifying and dispersing machine is preferably used.

A settling time to naturally settle the mixture after mixing is not particularly limited but is preferably 1 hour to 5 hours, and more preferably 1 hour to 3 hours. By controlling the settling time, the content of particles having a small circle equivalent diameter may be adjusted and thus it is preferable to control the settling time to be appropriate so that the content of the brilliant pigment particles having a circle equivalent diameter of 4.0 μm or less with respect to the total number of the brilliant pigment particles is 20% by number or less.

Coating Layers

The brilliant pigment according to the exemplary embodiment preferably has a metal pigment, a first coating layer which coats a surface of the metal pigment and includes at least one metal oxide selected from the group consisting of silica, alumina, and titania, and a second coating layer which coats a surface of the first coating layer and includes a resin.

The first coating layer which constitutes the coated pigment includes a metal oxide selected from the group consisting of silica, alumina, and titania, and these oxides may be used singly or in combination of two or more thereof.

Among these, from the viewpoints of excellent chemical resistance when the toner particles are produced, and coating of the surface of the pigment in a substantially more uniform state, silica is preferable.

The first coating layer may be formed only with the metal oxide but may contain impurities included in the layer during production.

In the exemplary embodiment, an elemental ratio Mb/Ma of a metal Ma in the metal pigment and a metal Mb in the first coating layer is preferably from 0.08 to 0.20. In addition, the elemental ratio Mb/Ma is more preferably from 0.1 to 0.18, and even more preferably from 0.12 to 0.16.

When the elemental ratio Mb/Ma is 0.20 or less, an image having excellent brilliance may be formed without lowering the light reflectance by the first coating layer. Further, when the elemental ratio Mb/Ma is 0.08 or more, the surface of the metal pigment is uniformly coated and thus the transferability under a high temperature and high humidity is improved.

The amount of elements when the elemental ratio Mb/Ma is obtained is measured using a fluorescence X-ray analyzer (XRF).

Specifically, using a press forming machine, a compression pressure of 10 tons is applied to 5 g of toner particles and a device having a diameter of 5 cm is prepared to set the device as a sample for measurement. The amount of metal elements in the metal pigment and the first coating layer may be measured from the sample using a fluorescence X-ray analyzer (XRF-1500), manufactured by Shimadzu Corporation, under measurement conditions of a tube voltage of 40 KV, a tube current of 90 mA, and a measurement time of 30 minutes.

Examples of a method of coating the surface with the metal oxide include a method of forming a coating layer of a metal oxide on a surface of a metal pigment by a sol-gel method, and a method of precipitating a metal hydroxide to a surface of a metal pigment, and causing crystallization at a low temperature to form a coating layer of a metal oxide.

In the exemplary embodiment, it is preferable to use a method of precipitating a metal oxide to a surface of a metal by adding an organic metal compound such that the elemental ratio Mb/Ma is within a range of 0.08 to 0.20, and adjusting the pH of a dispersion containing the metal pigment with the addition of a hydrolysis catalyst in the dispersion.

The coating amount of the first coating layer is preferably from 10% by weight to 40% by weight, and more preferably from 20% by weight to 30% by weight with respect to the weight of the metal pigment.

Further, the coating amount of the first coating layer is measured by a calibration curve which is obtained by measuring a mixture of an aluminum pigment and a silica pigment in advance using a fluorescence X-ray analyzer (XRF).

The second coating layer which constitutes the coated pigment is preferably a layer that is coated with a resin.

As the resin used herein, for example, resins known as binder resins of toner particles, as described later, such as an acrylic resin, and a polyester resin, may be used.

Among these, from the viewpoint of uniform coating of the surface of the pigment, an acrylic resin is preferable.

In addition, from the viewpoints of excellent chemical resistance when the toner particles are produced and impact resistance, the second coating layer is preferably a layer formed with a cross-linked resin.

The second coating layer may be formed only with the resin but may contain impurities included in the layer during production.

The coating amount of the second coating layer is preferably from 5% by weight to 30% by weight, more preferably from 10% by weight to 25% by weight, and even more preferably from 15% by weight to 20% by weight with respect to the weight of the metal pigment.

When the coating amount of the second coating layer is 5% by weight or more, coatability of the coated pigment with a binder resin is maintained and the transferability under a high temperature and high humidity is prevented from being lowered. In addition, when the coating amount of the second coating layer is 20% by weight or less, the specular reflectance is prevented from being lowered by the resin that constitutes the second coating layer, and an image having excellent brilliance is formed.

Further, the coating amount of the second coating layer is measured by a weight reduction rate when the temperature is increased from 30° C. to 600° C. at a temperature rise rate of 30° C./min in a nitrogen gas stream using a thermo-gravimetric analyzer (TGA).

When the coating amount of the second coating layer of the coated pigment in the toner particle is measured, the above-described method may be used after components such as a binder resin (a release agent, and other components) are removed from the toner particle by methods of dissolution and combustion.

In addition, since a release agent, and other components are mixed in the binder resin in the toner particle, the mixed region of the components and the second coating layer in the coated pigment are distinguished from each other and thus the coating amount of the second coating layer may be measured.

The second coating layer is formed in the following manner.

That is, the coated pigment on which the first coating layer is formed is separated into solid and liquid, and optionally, washing is performed. Then, the pigment is dispersed in a solvent and a polymerizable monomer and a polymerization initiator are added thereto under stirring to perform heat treatment. Thus, the resin on the surface of the metal pigment is precipitated.

In this manner, the second coating layer is formed.

In the toner according to the exemplary embodiment, the content of the coated pigment is preferably from 1 part by weight to 70 parts by weight, and more preferably from 5 parts by weight to 50 parts by weight with respect to 100 parts by weight of the binder resin which will be described later.

Azo Yellow Pigment

Examples of the azo yellow pigment used in the exemplary embodiment include monoazo pigments such a C.I. pigment yellow 74, C.I. pigment yellow 1, C.I. pigment yellow 2, C.I. pigment yellow 3, C.I. pigment yellow 5, C.I. pigment yellow 6, C.I. pigment yellow 49, C.I. pigment yellow 65, C.I. pigment yellow 73, C.I. pigment yellow 75, C.I. pigment yellow 97, C.I. pigment yellow 98, C.I. pigment yellow 111, C.I. pigment yellow 116, and C.I. pigment yellow 130, condensed disazo pigments such as C.I. Pigment Yellow 93, C.I. Pigment Yellow 94, C.I. Pigment Yellow 95, C.I. Pigment Yellow 128, and C.I. Pigment Yellow 166, and disazo pigments such as C.I. Pigment Yellow 12, C.I. Pigment Yellow 13, C.I. Pigment Yellow 14, C.I. Pigment Yellow 17, C.I. Pigment Yellow 55, C.I. Pigment Yellow 63, C.I. Pigment Yellow 81, C.I. Pigment Yellow 83, C.I. Pigment Yellow 87, C.I. Pigment Yellow 90, C.I. Pigment Yellow 106, C.I. Pigment Yellow 113, C.I. Pigment Yellow 114, C.I. Pigment Yellow 121, C.I. Pigment Yellow 124, C.I. Pigment Yellow 126, C.I. Pigment Yellow 127, C.I. Pigment Yellow 136, C.I. Pigment Yellow 152, C.I. Pigment Yellow 170, C.I. Pigment Yellow 171, C.I. Pigment Yellow 172, C.I. Pigment Yellow 174, C.I. Pigment Yellow 176, and C.I. Pigment Yellow 188. Among these, for the reason for pigment dispersibility, it is preferable to use C.I. Pigment Yellow 74 as the azo yellow pigment.

Magenta Pigment

Examples of a magenta pigment used in the exemplary embodiment include naphthol magenta pigment, quinacridone magenta pigments, diketopyrrolopyrrole magenta pigments, and indigo magenta pigments. Among these, for the reason for chargeability and safety, it is preferable that at least one selected from the group consisting of naphthol magenta pigments and quinacridone magenta pigments be used as the magenta pigment.

Other Pigments

In the exemplary embodiment, pigments other than the above-described pigments may be used together with the above-described pigments. Examples of other pigments that may be used in the exemplary embodiment include carbon black, copper oxide, manganese dioxide, aniline black, activated carbon, non-magnetic ferrite, magnetite, red chrome yellow, molybdenum orange, permanent orange GTR, pyrazolone orange, vulcane orange, benzidine orange G, indanthrene brilliant orange RK, indanthrene brilliant orange GK, Prussian blue, cobalt blue, alkali blue lake, Victoria blue lake, fast sky blue, indanthrene blue BC, aniline blue, ultramarine blue, chalco oil blue, methylene blue chloride, phthalocyanine blue, phthalocyanine green, malachite green oxalate, manganese purple, fast violet B, methyl violet lake, chromium oxide, chrome green, pigment green, malachite green lake, final yellow green G, zinc white, titanium oxide, antimony white, and zinc sulfide.

The weight ratio of the azo yellow pigment and the magenta pigment included in the toner according to the exemplary embodiment is preferably 3:1 to 30:1. As long as the weight ratio of the magenta pigment is smaller than a weight ratio of 3:1, when a toner image is formed using the toner according to the exemplary embodiment, an image exhibiting satisfactory golden color may be obtained. The weight ratio of the azo yellow pigment and the magenta pigment included in the toner is more preferably 5:1 to 20:1, and particularly preferably 7:1 to 15:1.

Binder Resin

The toner according to the exemplary embodiment may contain a binder resin.

Examples of the binder resin used in the exemplary embodiment include polyolefin resins such as polyester, polyethylene, and polypropylene; styrene resins such as polystyrene and α-polymethylstyrene; (meth)acrylic resins such as polymethyl methacrylate and polyacrylonitrile; polyamide resins; polycarbonate resins; polyether resins; and copolymer resins thereof. Among these resins, polyester resins with which the smoothness of a surface of a fixed image becomes high and an image having further excellent brilliance may be obtained are preferably used.

In the following description, polyester resins that are particularly preferably used will be described.

The polyester resins according to the exemplary embodiment may be those obtained by, for example, polycondensation mainly of a polyvalent carboxylic acid and a polyol.

Examples of the polyvalent carboxylic acid include aromatic carboxylic acids such as terephthalic acid, isophthalic acid, phthalic anhydride, trimellitic anhydride, pyromellitic acid, and naphthalenedicarboxylic acid; aliphatic carboxylic acids such as maleic anhydride, fumaric acid, succinic acid, alkenyl succinic anhydride, and adipic acid; and alicyclic carboxylic acids such as cyclohexanedicarboxylic acid. These polyvalent carboxylic acids are used alone or in combination of two or more.

Among these polyvalent carboxylic acids, the aromatic carboxylic acids are preferably used. Furthermore, in order to form a cross-linked structure or a branched structure and to obtain fixability, a trivalent or higher carboxylic acid (such as trimellitic acid or an anhydride thereof) is preferably used in combination with a dicarboxylic acid.

Examples of the polyol include aliphatic diols such as ethylene glycol, diethylene glycol, triethylene glycol, propylene glycol, butanediol, hexanediol, neopentyl glycol, and glycerol; alicyclic diols such as cyclohexanediol, cyclohexanedimethanol, and hydrogenated bisphenol A; and aromatic diols such as ethylene oxide adducts of bisphenol A and propylene oxide adducts of bisphenol A. These polyols are used alone or in combination of two or more.

Among these polyols, aromatic diols and alicyclic diols are preferable. Among these, aromatic diols are more preferable. Furthermore, in order to form a cross-linked structure or a branched structure and to further obtain fixability, a trivalent or higher polyol (such as glycerol, trimethylolpropane, or pentaerythritol) may also be used in combination with a diol.

The toner according to the exemplary embodiment may contain a crystalline polyester resin as the binder resin from the viewpoints of further exhibiting a rapid change in viscosity by heating and further achieving both the mechanical strength and the low temperature fixability.

The content of the crystalline polyester resin in the toner according to the exemplary embodiment is preferably from 2% by weight to 30% by weight, and more preferably from 4% by weight to 25% by weight.

The melting temperature of the crystalline polyester resin is preferably within a range of 50° C. to 100° C., more preferably within a range of 55° C. to 95° C., and even more preferably within a range of 60° C. to 90° C.

The term "crystalline polyester resin" according to the exemplary embodiment refers to a polyester resin that does not exhibit a stepwise change in the endotherm but has a specific endothermic peak in differential scanning calorimetry (hereinafter, simply referred to as DSC). In the case in which the crystalline polyester resin is a polymer obtained by copolymerizing another component with the main chain of the polyester resin, when the content of the other component is 50% by weight or less, the resulting copolymer is also referred to as a crystalline polyester.

The above crystalline polyester resin is synthesized from an acid (dicarboxylic acid) component and an alcohol (diol) component. In the description below, the term "constituent component derived from an acid" in a polyester resin refers to a moiety that has been the acid component before the synthesis of the polyester resin. The term "constituent component derived from an alcohol" refers to a moiety that has been the alcohol component before the synthesis of the polyester resin.

Constituent Component Derived from Acid

Examples of the acid for forming the constituent component derived from an acid include various dicarboxylic acids. The acid for forming the constituent component derived from an acid in the crystalline polyester resin according to the exemplary embodiment is preferably a straight-chain aliphatic dicarboxylic acid.

Examples thereof include, but are not limited to, oxalic acid, malonic acid, succinic acid, glutaric acid, adipic acid, pimelic acid, suberic acid, azelaic acid, sebacic acid, 1,9-nonane dicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, and 1,18-octadecanedicarboxylic acid; and lower alkyl esters and acid anhydrides thereof. Among these aliphatic dicarboxylic acids, adipic acid, sebacic acid, and 1,10-decanedicarboxylic acid are preferable.

The constituent component derived from an acid may contain other constituent components such as a constituent component derived from a dicarboxylic acid having a double bond or a constituent component derived from a dicarboxylic acid having a sulfonic acid group.

Examples of the dicarboxylic acid having a sulfonic group include, but are not limited to, sodium 2-sulfoterephthalate, sodium 5-sulfoisophthalate, and sodium sulfosuccinate. Examples thereof further include lower alkyl esters and acid anhydrides thereof. Among these, sodium 5-sulfoisophthalate and the like are preferable.

The content of the constituent component derived from an acid (the content of the constituent component derived from a dicarboxylic acid having a double bond and/or the constituent component derived from a dicarboxylic acid having a sulfonic acid group) other than the constituent component derived from an aliphatic dicarboxylic acid in the total constituent components derived from acids is preferably from 1% by constitutional mole to 20% by constitutional mole, and more preferably from 2% by constitutional mole to 10% by constitutional mole.

Herein, the "% by constitutional mole" represents a percentage when the amount of target constituent component derived from an acid in the total amount of constituent components derived from acids or the amount of target constituent component derived from an alcohol in the total amount of constituent components derived from alcohols in the polyester resin is assumed to be 1 unit (mole).

Constituent Component Derived from Alcohol

The alcohol for forming the constitutional component derived from an alcohol is preferably aliphatic diols. Examples of the aliphatic diol include, but are not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-dodecanediol, 1,12-undecanediol, 1,13-tridecanediol, 1,14-tetradecanediol, 1,18-octadecanediol, and 1,20-eicosanediol. Among these diols, ethylene glycol, 1,4-butanediol, and 1,6-hexanediol are preferable.

Method of Producing Polyester Resin

A method of producing the polyester resin is not particularly limited, and the polyester resin is produced by a normal polyester polymerization method in which an acid component and an alcohol component are allowed to react with each other. For example, the polyester resin is produced by properly employing a direct polycondensation method, an ester interchange method, or the like depending on the types of monomers used. The molar ratio (acid component/alcohol component) in the reaction between the acid component and the alcohol component is different depending on the reaction conditions and the like. However, the molar ratio is preferably about 1/1 from the standpoint of achieving a high molecular weight.

Examples of a catalyst that may be used in the production of the polyester resin include compounds of an alkali metal such as sodium or lithium; compounds of an alkaline earth metal such as magnesium or calcium; compounds of a metal such as zinc, manganese, antimony, titanium, tin, zirconium, or germanium; phosphorous acid compounds; phosphoric acid compounds; and amine compounds.

The molecular weight of the binder resin (weight average molecular weight; Mw) is preferably from 15,000 to 300,000, and more preferably from 25,000 to 130,000.

In the exemplary embodiment, the weight average molecular weight of the binder resin is measured by gel permeation chromatography (GPC) and calculated. Specifically, the weight average molecular weight of the binder resin is measured with a tetrahydrofuran (THF) solvent using an HLC-8120 GPC system produced by Tosoh Corporation and a TSKgel Super HM-M column (15 cm) produced by Tosoh Corporation. Next, the weight average molecular weight of the binder resin is calculated on the basis of a molecular weight calibration curve prepared using monodisperse polystyrene standard samples.

Release Agent

The toner according to the exemplary embodiment preferably contains a release agent.

Specific examples of the release agent preferably include ester wax, polyethylene, polypropylene, and a copolymer of polyethylene and polypropylene, polyglycerin wax, microcrystalline wax, paraffin wax, carnauba wax, Sasol wax, montanic acid ester wax, and deoxygenated carnauba wax; unsaturated fatty acids such as palmitic acid, stearic acid, montanic acid, planjin acid, eleostearic acid, and parinaric acid; saturated alcohols such as long-chain alkyl alcohols such as stearyl alcohol, aralkyl alcohol, behenyl alcohol, carnaubyl alcohol, ceryl alcohol, and melissyl alcohol, and other alcohols having a long alkyl chain; polyols such as sorbitol; fatty acid bisamides such as linolic acid amide, oleic acid amide, and lauric acid amide; saturated fatty acid bisamides such as methylene bisstearic acid amide, ethylene biscapric acid amide, ethylene bislauric acid amide, and hexamethylene bisstearic acid amide; unsaturated fatty acid amides such as ethylene bisoleic acid amide, hexamethylene bisoleic acid amide, N,N'-dioleyladipic acid amide, and N,N'-dioleylcebacic acid amide; aromatic bisamides such as m-xylenebisstearic acid amide and N,N'-distearylisophthalic acid amide; metallic salts of fatty acids such as calcium stearate, calcium laurate, zinc stearate, and magnesium stearate (which are commonly referred to as metallic soaps); waxes of aliphatic hydrocarbon waxes grafted with a vinyl monomer such as styrene or acrylic acid; partially esterified products of fatty acid such as behenic acid monoglyceride and polyols; and methyl ester compounds of vegetable oil hydrogenated to have a hydroxyl group.

The release agents may be used singly or in combination of two or more thereof.

The content of the release agent is preferably in a range of 1% by weight to 20% by weight, and more preferably in a range of 3% by weight to 15% by weight with respect to 100% by weight of the binder resin. When the content of the release agent is within the range, satisfactory fixing and image properties may be achieved.

Other Additives

Besides the above-described components, other components such as an internal additive, a charge-controlling agent, an inorganic powder (inorganic particles), organic particles, and the like may also be optionally incorporated in the toner according to the exemplary embodiment.

Examples of the charge-controlling agent include quaternary ammonium salt compounds, nigrosine compounds, dyes composed of a complex of aluminum, iron, chromium, or the like, and triphenylmethane pigments.

Examples of the inorganic particles include known inorganic particles such as silica particles, titanium oxide particles, alumina particles, cerium oxide particles, and particles obtained by hydrophobizing the surfaces of these particles. These inorganic particles may be used alone or in combination of two or more. Among these inorganic particles, silica particles, which have a refractive index lower than that of the above-mentioned binder resin, are preferably used. The silica particles may be subjected to a surface treatment. For example, silica particles surface-treated with a silane coupling agent, a titanium coupling agent, silicone oil, or the like are preferably used.

Properties of Toner

The brilliant toner according to an exemplary embodiment (hereinafter, also simply referred to as a "toner") has, when a solid image in which a toner applied amount is 4.0 g/m$^2$ is formed, a color saturation of 25 to 55, a hue angle of 65° to 95°, and a lightness of 50 to 80 in the image.

The color saturation is preferably 30 to 50, and more preferably 35 to 45.

The hue angle is preferably 70° to 90°, and more preferably 75° to 85°.

The lightness is preferably 55 to 75, and more preferably 60 to 70.

The toner according to the exemplary embodiment preferably has a volume average particle diameter preferably in a range of 2 μm to 20 μm, more preferably in a range of 3 μm to 15 μm, and even more preferably in a range of 5 μm to 10 μm. When the volume average particle diameter is 2 μm or more, the fluidity of the toner is improved and the chargeability of each particle is easily improved. Since the charge distribution is spread, background fogging and toner leakage from a developer unit do not easily occur. Further, when the volume average particle diameter is 2 μm or more, the cleanability does not become poor. When the volume average particle diameter is 20 μm or less, the resolution is improved, so that the sufficient image quality is obtained. Hence, the recent demand toward high image quality is satisfied.

The volume average particle diameter may be measured using Coulter Multisizer II (manufactured by Coulter Company), with an aperture diameter of 50 μm. In this case, the toner is dispersed in an aqueous electrolyte solution (aqueous isoton solution) by ultrasonication for 30 seconds or more, and then used for the measurement.

Further, the toner according to the exemplary embodiment is preferably a spherical shape having a shape factor SF1 in a range of 110 to 140. When the toner has a spherical shape, in which the shape factor is within the above range, the transfer efficiency and the density of the resulting image are improved, to form a high-quality image.

The shape factor SF1 is more preferably in a range of from 110 to 130.

Here, the shape factor SF1 may be obtained by the following equation (1).

$$SF1=(ML^2/A)\times(\pi/4)\times 100 \qquad \text{Equation (1)}$$

In the equation (1), ML represents the absolute maximum length of the particle, and A represents the projected area of the particle.

The SF1 is expressed as a numerical figure analyzed by mainly using an image analyzer to analyze a microscopic image or a scanning electron microscope (SEM) image and calculated, for example, in the following manner. That is, an optical microscopic image of particles spread on the surface of a slide glass is input into a Luzex image processor via a video camera to obtain the maximum lengths and projected areas of 100 particles. Then, the SF1 is determined by calculation according to the equation (1) to obtain the average thereof.

In the brilliant toner according to the exemplary embodiment, when a toner solid image is formed, a ratio (A/B) between a reflectance A at an acceptance angle of +30° which is measured when the solid image is irradiated with incident light at an incidence angle of −45° by the use of the goniophotometer and a reflectance B at an acceptance angle of −30° is preferably from 2 to 100. When the ratio is within the above-described range, the brilliance of the obtained image becomes further excellent.

The ratio (A/B) is preferably from 20 to 100, more preferably from 40 to 100, even more preferably from 50 to 100, and particularly preferably from 60 to 90.

Measurement of Ratio (A/B) by Goniophotometer

Here, first, an incidence angle and an acceptance angle will be described. During the measurement by the use of the goniophotometer in the exemplary embodiment, the incident angle is −45°. This is because the measuring sensitivity of an image having a wide range of glossness is high.

In addition, the reason why the acceptance angle is −30° and +30° is that the measuring sensitivity is the highest to evaluate an image with brilliance and an image without brilliance.

Next, a method of measuring the ratio (A/B) will be described.

In the exemplary embodiment, when the ratio (A/B) is measured, first, a "solid image" is formed by the following method. DocuCentre-III C7600, manufactured by Fuji Xerox Co., Ltd., is filled with a developer as a sample, and a solid image in which the toner applied amount is 4.5 g/cm$^2$ is formed on a recording sheet (an OK top-coated+sheet of paper, manufactured by Oji Paper Co., Ltd.) at a fixing temperature of 190° C. with a fixing pressure of 4.0 kgf/cm$^2$. The "solid image" means an image with a printing rate of 100%.

The image part of the formed solid image is irradiated with incident light at an incidence angle of −45° on the solid image using a variable angle photometer GC5000L, manufactured by Nippon Denshoku Industries Co., Ltd., as a goniophotometer, and a reflectance A at an acceptance angle of +30° and a reflectance B at an acceptance angle of −30° are measured. The reflectance A and the reflectance B are measured at intervals of 20 nm using light in the wavelength range of 400 nm to 700 nm and the average reflectance at the wavelengths is calculated. The ratio (A/B) is calculated from these measurement results.

In the brilliant toner according to the exemplary embodiment, the average circle equivalent diameter D of the toner is preferably larger than the average maximum thickness C of the toner.

A circle equivalent diameter M is given as the following equation, when the projection area in a flake surface of which the projection area is the maximum is X.

$$M=(X/\pi)^{1/2}$$

The toner particle shown in FIG. 1 is a flake-shape toner particle in which the circle equivalent diameter M is larger than the maximum thickness L.

In the brilliant toner according to the exemplary embodiment, a ratio (C/D) between the average maximum thickness C of the toner particles and the average circle equivalent diameter D of the toner particles is preferably from 0.001 to 0.5, more preferably from 0.01 to 0.5, and even more preferably from 0.05 to 0.1. When the ratio is within the above-described range, the brilliance of the obtained image becomes further excellent.

The average maximum thickness C and the average circle equivalent diameter D are measured by the following method.

The toner particles are put onto a smooth surface and are dispersed uniformly through the vibration. 1000 toner particles are magnified at a 1000 magnification by the use of a color laser microscope, "VK-9700" (manufactured by Keyence Corporation), the maximum thickness C and the circle equivalent diameter D in a plan view thereof are measured, and the arithmetic average values thereof are calculated.

Further, the average long axis length and the average short axis length are similarly calculated by magnifying 1000 toner particles at a 1000 magnification by the use of the color laser microscope, "VK-9700" (manufactured by Keyence Corporation), measuring the long axis lengths and the short axis lengths, and calculating the arithmetic average values thereof.

In the exemplary embodiment, the average maximum thickness C is preferably in the range of 1 μm to 6 μm and more preferably in the range of 2 μm to 5 μm.

The average circle equivalent diameter D is preferably in the range of 5 μm to 40 μm, more preferably in the range of 8 μm to 30 μm, and still more preferably in the range of 10 μm to 25 μm.

When the average maximum thickness C and the mean circle equivalent diameter D are in the above-mentioned ranges, it is possible to achieve excellent brilliance, which is preferable.

In the brilliant toner according to the exemplary embodiment, the number of the brilliant pigment particles in which the angle of the long axis direction of the brilliant pigment particles about the long axis direction of the toner particles in a cross section thereof is in the range of from −30° to +30° when the cross section is observed in the thickness direction of the toner particles preferably occupies 60% or more of the total brilliant pigment particles to be observed.

Figure 2:
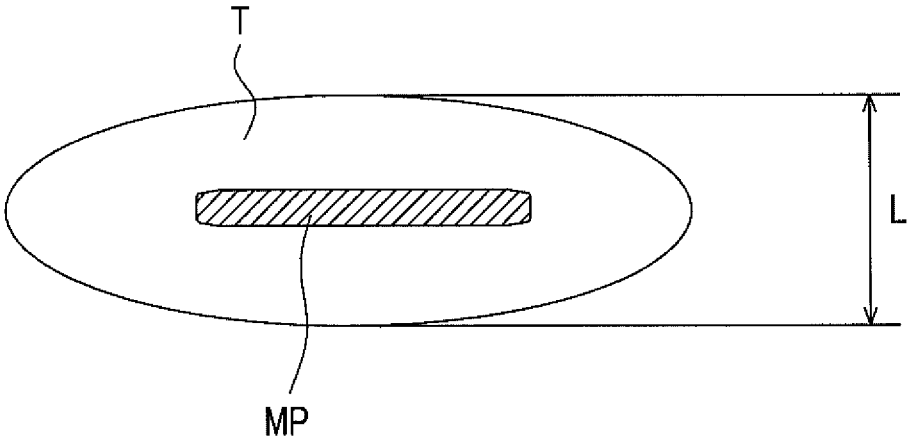
FIG. 2 is a cross-sectional view schematically showing an example of the electrostatic charge image developing toner according to the exemplary embodiment.

The toner T shown in FIGS. 1 and 2 is a flake-shape toner in which the circle equivalent diameter is larger than the thickness L, and contains flake-shape pigment particles MP.

As shown in FIG. 2, when the toner T has a flake shape in which the circle equivalent diameter is larger than the thickness L thereof and the toner particles move to an image holding member, an intermediate transfer member, or a recording medium in a developing process or a transfer process during formation of an image, the toner particles tend to move so as to cancel the electric charge thereof as much as possible and thus it is thought that the toner particles are arranged so that the attachment area is the maximum. That is, in a recording medium to which the toner particles are finally transferred, it is thought that the flake-shape toner particles are arranged so that the flake surfaces thereof face the surface of the recording medium. In a fixing process during formation of an image, it is thought that the flake-shape toner particles are arranged so that the flake surfaces thereof face the surface of the recording medium due to the fixing pressure. Particularly, by externally adding fluorine resin particles thereto, it is though that the toner particles are more easily arranged so that the attachment area is the maximum.

Therefore, it is thought that the pigment particles satisfying the requirement, "the angle of the long axis direction of the pigment particles about the long axis direction of the toner particles in a cross section is in the range of from −30° to +30°", in flake-shape pigment particles included in the toner particles are arranged so that the surfaces of which the area is the maximum face the surface of the recording medium. When the image formed in this manner is irradiated with light, it is thought that the ratio of the pigment particles irregularly reflecting the incident light is suppressed and thus the above-mentioned range of the ratio (A/B) is achieved.

As described above, when the cross section of the toner particle in the thickness direction thereof is observed, the number of the pigment particles in which the angle formed by the long axis direction of the toner particle in the cross section and the long axis direction of the pigment particles is in the range of from −30° to +30° preferably occupies 60% or more of the total number of pigment particles to be observed. In addition, the number is more preferably in the range of 70% to 95% and particularly preferably in the range of 80% to 90%.

When the number is 60% or more, it is possible to easily achieve excellent brilliance.

A method of observing a cross section of a toner particle will be described below.

Toner particles are embedded using a bisphenol A liquid epoxy resin and a curing agent to prepare a cutting sample. Next, the cutting sample is cut at −100° C. by the use of a cutter (LEICA ultra-microtome (manufactured by Hitachi High-Technologies Corporation) in the exemplary embodiment) using a diamond knife to prepare an observation sample. The cross sections of the toner particles are observed by magnifying the observation sample at an about 5,000 magnification by the use of a transmission electron microscope (TEM). In 1000 toner particles that have been observed, the number of pigment particles in which the angle formed by the long axis direction of the toner particle in the cross section and the long axis direction of the pigment particle is in the range of from −30° to +30° is counted by the use of an image analysis software program and the ratio is calculated.

The "long-axis direction of a toner particle in a cross section" means a direction perpendicular to the thickness direction in a toner particle of which the average circle equivalent diameter D is larger than the average maximum thickness C. The "long-axis direction of a pigment particle" means a length direction of the pigment particle.

Method of Producing Toner

A toner according to the exemplary embodiment may be produced by adding an external additive to toner particles after the toner particles are produced.

A method of producing toner particles is not particularly limited and toner particles may be prepared by known methods of a dry method, such as a kneading and pulverizing method, a wet method, such as an emulsification and aggregation method and a suspension and polymerization method, and the like.

The kneading and pulverizing method is a method in which respective materials such as a colorant are mixed, and then molten-kneaded using a kneader, an extruder, or the like to obtain a molten-kneaded material, and the obtained material is coarsely pulverized and then finely pulverized by a jet mill or the like to obtain toner particles having a target particle diameter using a wind classifier.

Among these methods, an emulsification and aggregation method is preferably since the shape of the toner particle and the diameter of the toner particle are easily controlled and a range for control a toner structure such as a core-shell structure is wide. Hereinafter, the method of producing toner particles by an emulsification and aggregation method will be described.

The emulsification and aggregation method of the exemplary embodiment includes an emulsification process of emulsifying raw materials constituting toner particles to form emulsified resin particles (emulsified particle), an aggregation process of forming aggregates of the resin particles, and a coalescence process of coalescing the aggregates.

Emulsification Process

A resin particle dispersion may be prepared by applying a shearing force to a solution, in which an aqueous medium and a binder resin are mixed, by a disperser, to be emulsified, as well as by using typical polymerization methods such as an emulsification polymerization method, a suspension polymerization method, and a dispersion polymerization method. At this time, particles may be formed by heating a resin component to lower the viscosity thereof. In addition, in order to stabilize the dispersed resin particles, a dispersant may be used. Furthermore, when the resin is dissolved in an oil solvent having relatively low solubility in water, the resin is dissolved in the solvent and particles thereof are dispersed in water with a dispersant and a polymer electrolyte, followed by heating and reduction in pressure to evaporate the solvent. As a result, the resin particle dispersion is prepared.

Examples of the aqueous medium include water such as distilled water or ion exchange water; and alcohols, and water is preferable.

In addition, examples of the dispersant which is used in the emulsification process include water-soluble polymers such as polyvinyl alcohol, methyl cellulose, ethyl cellulose, hydroxyethyl cellulose, carboxymethyl cellulose, sodium polyacrylate, and polysodium methacrylate; surfactants such as anionic surfactants, such as sodium dodecylbenzenesulfonate, sodium octadecylsulfate, sodium oleate, sodium laurate, and potassium stearate, cationic surfactants, such as laurylamine acetate, stearylamine acetate, and lauryltrimethylammonium chloride, zwitterionic surfactants, such as lauryl dimethylamine oxide, and nonionic surfactants, such as, polyoxyethylene alkyl ether, polyoxyethylene alkyl phenyl ether, or polyoxyethylene alkylamine; and inorganic salts, such as tricalciumphosphate, aluminum hydroxide, calcium sulfate, calcium carbonate, and barium carbonate.

Examples of the disperser which is used for preparing an emulsion include a homogenizer, a homomixer, a pressure kneader, an extruder, and a media disperser. With regard to the size of the resin particles, the average particle diameter (volume average particle diameter) thereof is preferably 1.0 μm or less, more preferably from 60 nm to 300 nm, and even more preferably from 150 nm to 250 nm. When the volume average particle diameter is 60 nm or more, the resin particles are likely to be unstable in the dispersion and thus the aggregation of the resin particles may be easy. In addition, when the volume average particle diameter is 1.0 μm or more, the particle diameter distribution of the toner particles may be narrowed.

When a release agent dispersion is prepared, a release agent is dispersed in water with an ionic surfactant and a polymer electrolyte such as a polyacid or a polymeric base and the resultant is heated at a temperature equal to or higher than the melting temperature of the release agent, followed by dispersion using a homogenizer to which a strong shearing force is applied and a pressure extrusion type disperser. Through the above-described process, a release agent dispersion is obtained. During the dispersion, an inorganic compound such as polyaluminum chloride may be added to the dispersion. Preferable examples of the inorganic compound include polyaluminum chloride, aluminum sulfate, highly basic aluminum chloride (BAC), polyaluminum hydroxide, and aluminum chloride. Among these, polyaluminum chloride and aluminum sulfate are preferable. The release agent dispersion is used in the emulsion aggregating method, but may also be used when the toner is prepared by the suspension polymerization method.

Through the dispersion, the release agent dispersion having release agent particles with a volume average particle diameter of 1 μm or less is obtained. It is more preferable that the volume average particle diameter of the release agent particles be from 100 nm to 500 nm.

When the volume average particle diameter is 100 nm or more, in general, although also being affected by properties of a binder resin to be used, it is easy to mix a release agent component with the toner. In addition, when the volume average particle diameter is 500 nm or less, the dispersion state of the release agent in the toner may be satisfactory.

When a dispersion of the colorant (azo yellow pigment and magenta pigment) is prepared, a well-known dispersion method may be used. For example, general dispersion units such as a rotary-shearing homogenizer, a ball mill having a medium, a sand mill, a dyno mill, or an Ultimizer are used, but the dispersion method is not limited thereto. The colorant is dispersed in water with an ionic surfactant and a polymer electrolyte such as a polyacid or a polymeric base. The volume average particle diameter of the dispersed colorant particles may be 1 μm or less, but preferably in a range of 80 nm to 500 nm because the colorant is uniformly dispersed in the toner without impairing aggregability.

A dispersion of a colorant (brilliant pigment) may be prepared in the same manner as in the preparation of the dispersion of the azo yellow pigment and magenta pigment, and a dispersion of a brilliant pigment coated with a resin may be prepared by dispersing and dissolving a brilliant pigment and a binder resin in a solvent for mixing, and dispersing the resultant in water through phase inversion emulsification or shearing emulsification.

Aggregation Process

In the aggregation process, the resin particle dispersion, the colorant dispersion, and the release agent dispersion and the like are mixed to obtain a mixture and the mixture is heated at the glass transition temperature of the resin particle or lower and aggregated to form aggregated particles. In most cases, the aggregated particles are formed by adjusting the pH value of the mixture to be acidic under stirring. The pH value is preferably in a range of 2 to 7. At this time, use of a coagulant is also effective.

In the aggregation process, the release agent dispersion and other various dispersions such as the resin particle dispersion may be added and mixed at once or in two or more batches.

As the coagulant, a surfactant having a reverse polarity to that of a surfactant which is used as the dispersant, an inorganic metal salt, and a divalent or higher valent metal complex may be preferably used. In particular, the metal complex is particularly preferable because the amount of the surfactant used may be reduced and charge properties are improved.

Particularly preferable examples of the inorganic metal salt include an aluminum salt and a polymer thereof. In order to obtain a narrower particle diameter distribution, a divalent inorganic metal salt is preferable to a monovalent inorganic metal salt, a trivalent inorganic metal salt is preferable to a divalent inorganic metal salt, and a tetravalent inorganic metal salt is preferable to a trivalent inorganic metal salt. In addition, when inorganic metal salts having the same valence are compared, a polymer type of inorganic metal salt polymer is more preferable.

In the exemplary embodiment, in order to obtain a narrower particle diameter distribution, a tetravalent inorganic metal salt polymer containing aluminum is preferably used.

In addition, after the aggregated particles have desired particle diameters, the resin particle dispersion is additionally added (coating process). As a result, a toner having a configuration in which the surfaces of core aggregated particles are coated with resin may be prepared. In this case, the release agent and the colorant are not easily exposed to the surface of the toner, which is preferable from the viewpoints of chargeability and developability. When additional components are added, a coagulant may be added or the pH value may be adjusted before the addition.

Coalescing Process

In the coalescing process, under stirring conditions based on the aggregation process, by increasing the pH value of a suspension of the aggregated particles to be in a range of 3 to 9, aggregation is stopped. Then, heating is performed at the glass transition temperature of the resin or higher to coalesce the aggregated particles. In addition, when the resin is used for coating, the resin is also coalesced and coats the core aggregated particles. The heating time may be determined according to a coalescing degree and may be approximately from 0.5 hour to 10 hours.

After coalescing, cooling is performed to obtain coalesced particles. In addition, in the cooling process, a cooling rate may be reduced at the glass transition temperature of the resin (the range of the glass transition temperature ±10° C.), that is, so-called slow cooling may be performed to promote crystallization.

The coalesced particles which are obtained after coalescing may be subjected to a solid-liquid separation process such as filtration, and optionally, to a cleaning process and a drying process to obtain toner particles.

In order to adjust charging, impart fluidity, and impart charge exchange properties, inorganic oxide or the like which is represented by silica, titania, and alumina may be added and attached to the obtained toner particles as an external additive. The above processes may be performed with a V-shape blender, a Henschel mixer, or a Löedige mixer and the attachment may be performed in plural steps. The amount of the external additive added is preferably in a range of 0.1 part by weight to 5 parts by weight, and more preferably in a range of 0.3 part by weight to 2 parts by weight, with respect to 100 parts by weight of the toner particles.

Furthermore, optionally, after external addition, coarse particles of toner may be removed using an ultrasonic sieving machine, a vibrating sieving machine, or a wind classifier.

Furthermore, in addition to the external additive, other components (particles) such as a charge-controlling agent, organic particles, a lubricant, and an abrasive may be added.

The charge-controlling agent is not particularly limited, and a colorless or light-color material is preferably used. Examples thereof include quaternary ammonium salt compounds, nigrosine compounds, a complex of aluminum, iron, chromium, or the like, and triphenylmethane pigments.

Examples of the organic particles include particles of vinyl resins, polyester resins, silicone resins, and the like, which are usually used for surfaces of toner particles as the external additive. The organic particles and inorganic particles are used as a fluid aid, a cleaning aid, or the like.

Examples of the lubricant include fatty acid amides such as ethylene bis stearamide and oleamide, and fatty acid metal salts such as zinc stearate and calcium stearate.

Examples of the abrasive include silica, alumina, and cerium oxide described above.

When the toner particles are formed by the emulsion aggregating method, it is thought that the brilliant pigment, the azo yellow pigment, and the magenta pigment, which are some of the constituent components for the toner, are respectively highly dispersed and the dispersibility is maintained until the toner particles are fixed to paper by the action of the surfactant. In this manner, it is though that as long as the dispersibility of each pigment is maintained, the brilliant pigment and the magenta pigment function as a shield to avoid the azo yellow pigment from being directly irradiated with ultraviolet light. In addition, due to the same mechanism, the light reflected from the brilliant pigment may be also partially avoided.

Electrostatic Charge Image Developer

An electrostatic charge image developer according to an exemplary embodiment (hereinafter, simply referred to as a developer) includes at least the toner according to the exemplary embodiment.

The toner according to the exemplary embodiment may be used as a single-component developer as it is or a two-component developer. When the toner is used as a two-component developer, a carrier is mixed with the toner.

The carrier which may be used for the two-component developer is not particularly limited, and a well-known carrier may be used. For example, a resin-coated carrier which has a resin coating layer on the surface of a core formed of magnetic metal such as iron oxide, nickel, or cobalt and magnetic oxide such as ferrite or magnetite, and a magnetic powder-dispersed carrier may be used. In addition, a resin-dispersed carrier in which a conductive material and the like are dispersed in a matrix resin may be used.

Examples of the coating resin and the matrix resin which are used for the carrier include polyethylene, polypropylene, polystyrene, polyvinyl acetate, polyvinyl alcohol, polyvinyl butyral, polyvinyl chloride, polyvinyl ether, polyvinylketone, vinyl chloride-vinyl acetate copolymer, styrene-acrylic acid copolymer, linear silicone resin having an organosiloxane bond or a modified product thereof, fluororesin, polyester, polycarbonate, phenol resin, and epoxy resin. However, the coating resin and the matrix resin are not limited to these examples.

Examples of the conductive material include metals such as gold, silver, and copper, carbon black, titanium oxide, zinc oxide, barium sulfate, aluminum borate, potassium titanate, and tin oxide. However, the conductive material is not limited to these examples.

In addition, examples of the core of the carrier include a magnetic metal such as iron, nickel or cobalt, a magnetic oxide such as ferrite or magnetite, and glass beads. In order to apply a magnetic brush method to the carrier, a magnetic material is preferable. In general, the volume average particle diameter of the core of the carrier is in a range of 10 μm to 500 μm and preferably in a range of 30 μm to 100 μm.

In order to coat the surface of the core of the carrier with resin, there may be used, for example, a coating method using a coating layer forming solution which is obtained by dissolving the coating resin and optionally, various additives in an appropriate solvent. The solvent is not particularly limited and may be selected according to coating resin to be used, coating aptitude, and the like.

Specific examples of the resin coating method include a dipping method in which the core of the carrier is dipped in the coating layer forming solution, a spray method in which the coating layer forming solution is sprayed on the surface of the core of the carrier, a fluid bed method in which the coating layer forming solution is sprayed on the core of the carrier in a state of floating through flowing air, and a kneader coater method in which the core of the carrier and the coating layer forming solution are mixed in a kneader coater and the solvent is removed.

In the two-component developer, the mixing ratio (weight ratio) of the toner according to the exemplary embodiment and the carrier is preferably in a range of about 1:100 to 30:100 (toner:carrier) and more preferably in a range of about 3:100 to 20:100.

Toner Cartridge, Process Cartridge, Image Forming Apparatus, and Image Forming Method An image forming apparatus according to the exemplary embodiment includes a latent image holding member, a charging unit that charges a surface of the latent image holding member, an electrostatic charge image forming unit that forms an electrostatic charge image on the surface of the latent image holding member, a developing unit that develops the electrostatic charge image with the developer according to the exemplary embodiment to form a toner image, a transfer unit that transfers the toner image onto a recording medium, and a fixing unit that fixes the toner image to the recording medium.

The image forming apparatus according to the exemplary embodiment may be an image forming apparatus in which each toner image held on the latent image holding member is sequentially and primarily transferred to an intermediate transfer member repeatedly, or may be a tandem type image forming apparatus in which plural latent image holding members including developing units for each color are arranged in tandem on the intermediate transfer member, for example.

The image forming apparatus according to the exemplary embodiment may have a cartridge structure (a process cartridge) in which a part including the developing unit accommodating the developer according to the exemplary embodiment is detachable from the image forming apparatus, or a cartridge structure (a toner cartridge) in which a part containing the toner according to the exemplary embodiment as a replenishing toner supplied to the developing unit is detachable from the image forming apparatus, for example.

By the image forming apparatus according to the exemplary embodiment, the image forming method according to the exemplary embodiment including a charging process of charging a surface of a latent image holding member, an electrostatic charge image forming process of forming an electrostatic charge image on the surface of the latent image holding member, a developing process of developing the electrostatic charge image by using the developer according to the exemplary embodiment to form a toner image, a transfer process of transferring the toner image to a recording medium, and a fixing process of fixing the toner image to the recording medium is performed.

Hereinafter, the image forming apparatus according to the exemplary embodiment will be described with reference to the drawing.

Figure 3:
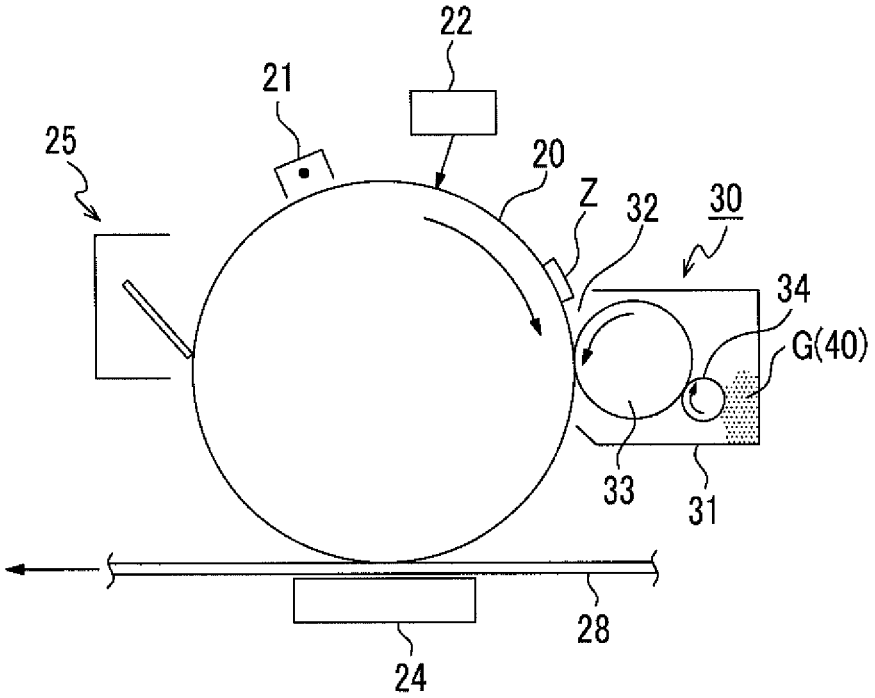
FIG. 3 is a schematic configurational view illustrating an example of an image forming apparatus according to the exemplary embodiment.

FIG. 3 is a schematic configurational view illustrating an example of an image forming apparatus according to the exemplary embodiment including a developing device to which the electrostatic charge image developer according to the exemplary embodiment is applied.

In the same drawing, the image forming apparatus according to the exemplary embodiment includes a photoreceptor 20 as an image holding member which rotates in a predetermined direction. In the vicinity of this photoreceptor 20, a charging device 21 (an example of the charging unit) which charges the photoreceptor 20 (an example of the image holding member), an exposure device 22 (an example of the electrostatic charge image forming unit) which forms an electrostatic charge image Z on the photoreceptor 20, a developing device 30 (an example of the developing unit) which visualizes the electrostatic charge image Z formed on the photoreceptor 20, a transfer device 24 (an example of the transfer unit) which transfers a toner image, visualized on the photoreceptor 20, onto a recording sheet 28 which is a recording medium, and a cleaning device 25 (an example of a cleaning unit) which cleans toner remaining on the photoreceptor 20 are disposed in order.

In the exemplary embodiment, as shown in FIG. 3, the developing device 30 has a developing vessel 31 that contains a developer G including a toner 40. The developer container 31 has a developing opening 32 formed to be opposed to the photoreceptor 20, and a developing roll (developing electrode) 33 as a toner holding member arranged to face the developing opening 32. When a predetermined developing bias is applied to the developing roll 33, a developing electric field is formed in a region (developing region) sandwiched between the photoreceptor 20 and the developing roll 33. In the developer container 31, a charge injection roll (injection electrode) 34 as a charge injection member is provided to be opposed to the developing roll 33. Particularly, in the exemplary embodiment, the charge injection roll 34 also acts as a toner supply roll for supplying the toner 40 to the developing roll 33.

Herein, the charge injection roll 34 may be rotated in an arbitrarily selected direction, but in consideration of supply properties of the toner and charge injection properties, it is preferable that the charge injection roll 34 be rotated in the same direction as that of the developing roll 33 at a part opposed to the developing roll 33 with a difference in the peripheral velocity (for example, 1.5 times or greater), and the toner 40 be held in a region sandwiched between the charge injection roll 34 and the developing roll 33 and scraped to inject charges.

Next, an operation of the image forming apparatus according to the exemplary embodiment will be described.

When an image forming process is started, first, the surface of the photoreceptor 20 is charged by the charging device 21, the exposure device 22 records an electrostatic charge image Z on the charged photoreceptor 20, and the developing device 30 visualizes the electrostatic charge image Z as a toner image. Then, the toner image on the photoreceptor 20 is transported to a transfer site, and the transfer device 24 electrostatically transfers the toner image on the photoreceptor 20 onto a recording sheet 28 as a recording medium. The toner remaining on the photoreceptor 20 is cleaned by the cleaning device 25. Thereafter, the toner image on the recording sheet 28 is fixed by a fixing device (an example of the fixing unit) to obtain an image.

Process Cartridge and Toner Cartridge

A process cartridge according to the exemplary embodiment will be described.

The process cartridge according to the exemplary embodiment includes a developing unit that accommodates the electrostatic charge image developer according to the exemplary embodiment and develops an electrostatic charge image formed on a surface of an image holding member with the electrostatic charge image developer to form a toner image, and is configured to be detachable from an image forming apparatus.

The process cartridge according to the exemplary embodiment is not limited to the above-described configuration and may be configured to have a developing device and optionally, for example, at least one selected from other units such as an image holding member, a charging unit, an electrostatic charge image forming unit, and a transfer unit in addition to the developing device.

Hereinafter, an example of the process cartridge according to the exemplary embodiment is shown but the configuration is not limited thereto. Main parts shown in the drawing will be described and description of other parts will be omitted.

Figure 4:
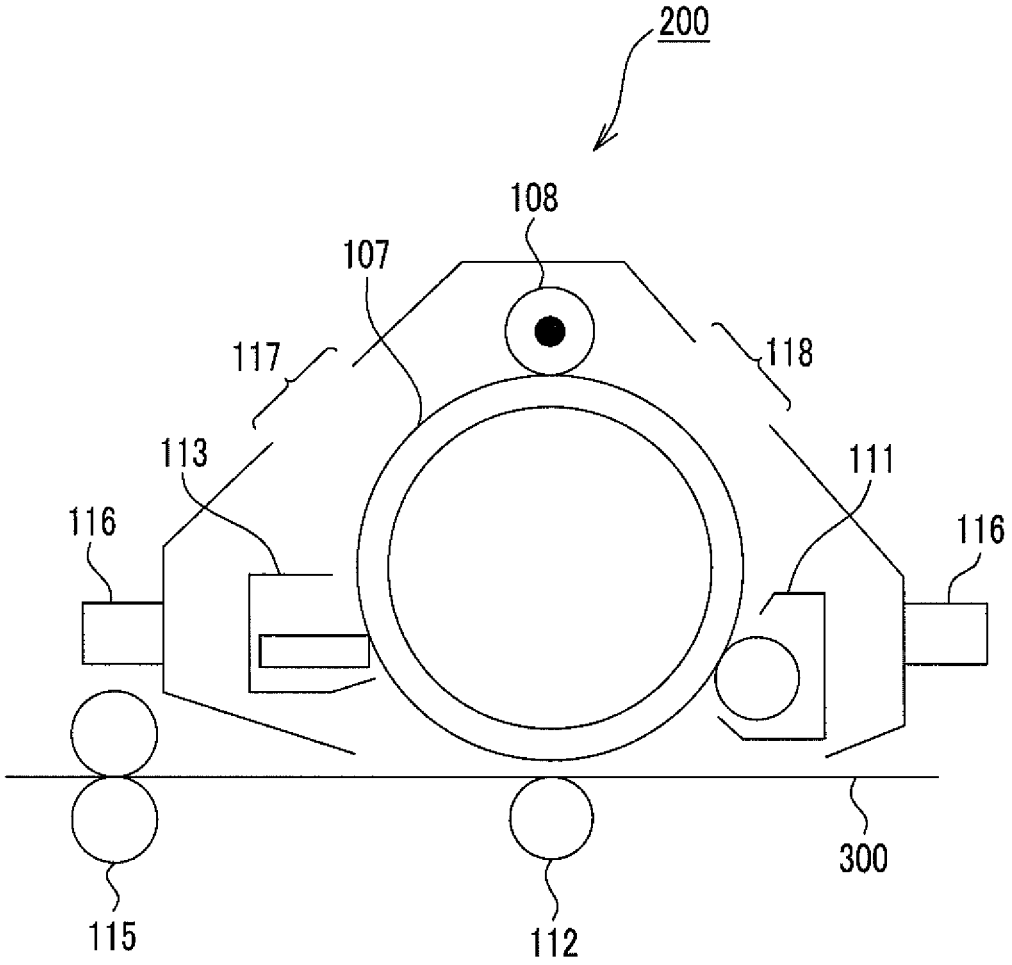
FIG. 4 is a schematic configurational view illustrating an example of a process cartridge according to the exemplary embodiment.

FIG. 4 is a schematic configurational view illustrating a process cartridge according to the exemplary embodiment.

For example, a process cartridge 200 shown in FIG. 4 includes a photoreceptor 107 (an example of the image holding member), a charging roll 108 (an example of the charging unit) provided around a photoreceptor 107, a developing device 111 (an example of the developing unit), and a photoreceptor cleaning device 113 (an example of the cleaning unit), which are combined and integrated by a housing 117 provided with an attachment rail 116 and an opening 118 for exposure to form a cartridge.

In FIG. 4, the reference number 109 denotes an exposure device (an example of the electrostatic charge image forming unit), the reference number 112 denotes a transfer device (an example of the transfer unit), the reference number 115 denotes a fixing device (an example of the fixing unit), and the reference number 300 denotes a recording sheet (an example of the recording medium).

An image forming apparatus shown in FIG. 3 is an image forming apparatus from which a toner cartridge (not shown) is freely detachable, and the developing device 30 is connected to the toner cartridge via a toner supply tube (not shown).

In addition, when the toner accommodated in the toner cartridge runs low, the toner cartridge may be replaced.

Examples

Hereinafter, this exemplary embodiment will be described in more detail using examples and comparative examples, but is not limited to the following examples.

Unless specifically noted, "parts" and "%" represent "parts by weight" and "% by weight".

Preparation of Toner 1

Preparation of Brilliant Pigment 1

Formation of First Coating Layer 154 parts (100 parts as aluminum content) of an aluminum pigment (manufactured by Showa Aluminum Powder K.K., 2173EA, solid content: 65%) is added to 500 parts of methanol, followed by stirring at 60° C. for 1.5 hours. Then, ammonia is added to the slurry, and then the pH value of the slurry is adjusted to 8.0. Next, 15 parts of tetraethoxysilane is added to the pH adjusted slurry, followed by further stirring at 60° C. for 5 hours. Then, the slurry is filtered and the obtained slurry containing a coated aluminum pigment is dried at 110° C. for 3 hours, thereby obtaining a brilliant pigment 1 coated with silica.

Formation of Second Coating Layer 500 parts of mineral spirit is added to the brilliant pigment 1 coated with silica followed by stirring. While nitrogen gas is supplied, the temperature is increased to 80° C. Next, 0.5 parts of acrylic acid, 9.8 parts of epoxidized polybutadiene, 12.2 parts of trimethylolpropane triacrylate, 4.4 parts of divinylbenzene, and 1.8 parts of azobisisobutyronitrile are added and polymerized at 80° C. for 5 hours. Then, the slurry is filtered and the obtained slurry containing a coated aluminum pigment is dried at 150° C. for 3 hours. In this manner, a brilliant pigment 1 having the first coating layer and the second coating layer is obtained.

Preparation of Brilliant Pigment Dispersion 1

Brilliant pigment 1: 100 parts

Anionic surfactant (manufactured by Dai-Ichi Kogyo Seiyaku Co., Ltd., Neogen R): 1.5 parts Ion exchange water: 400 parts The above components are mixed and dispersed for 1 hour using an emulsification dispersing machine Cavitron (manufactured by Pacific Machinery & Engineering Co., Ltd., CR1010), and the resultant is kept for about 2 hours to remove a supernatant. Further, 400 parts of ion exchange water is added and the mixture is dispersed for 1 hour using the emulsification dispersing machine Cavitron and kept for about 2 hours to remove a supernatant in the same manner. 400 parts of ion exchange water is added again and the resultant is dispersed for 1 hour, thereby preparing a brilliant pigment dispersion 1.

An aluminum pigment (solid content concentration: 20% by weight) in which when the circle equivalent diameter of the pigment particle is measured using a flow-type particle image analyzer FPIA-3000 (manufactured by Sysmex Corporation), the content of the pigment particle having an average circle equivalent diameter of 6.0 μm and a circle equivalent diameter of 4.0 μm or less is 8.9% by number, is obtained.

Preparation of Brilliant Pigment 2 and Brilliant Pigment Dispersion 2

Aluminum pigment (manufactured by Showa Aluminum Powder K.K., 2173EA, 6 μm): 100 parts Anionic surfactant (manufactured by Dai-Ichi Kogyo Seiyaku Co., Ltd., Neogen R): 1.5 parts Ion exchange water: 400 parts The above components are mixed and dispersed for 1 hour using an emulsification dispersing machine Cavitron (manufactured by Pacific Machinery & Engineering Co., Ltd., CR1010), and the resultant is kept for about 2 hours to remove a supernatant. Further, 400 parts of ion exchange water is added and the mixture is dispersed for 1 hour using the emulsification dispersing machine Cavitron and kept for about 2 hours to remove a supernatant in the same manner. 400 parts of ion exchange water is added again and the resultant is dispersed for 1 hour, thereby preparing a brilliant pigment dispersion 2.

An aluminum pigment (solid content concentration: 20% by weight) in which when the circle equivalent diameter of the pigment particles is measured using a flow-type particle image analyzer FPIA-3000 (manufactured by Sysmex Corporation), the content of the pigment particle having an average circle equivalent diameter of 5.8 μm and a circle equivalent diameter of 4.0 μm or less is 10.7% by number, is obtained.

Preparation of Brilliant Pigment Dispersion 3

Aluminum pigment (manufactured by Showa Aluminum Powder K.K., 2173EA): 100 parts Anionic surfactant (manufactured by Dai-Ichi Kogyo Seiyaku Co., Ltd., Neogen R): 1.5 parts Ion exchange water: 400 parts The above components are mixed and dispersed for 1 hour using an emulsification dispersing machine Cavitron (manufactured by Pacific Machinery & Engineering Co., Ltd., CR1010), thereby preparing a brilliant pigment dispersion 3 (solid content concentration: 20%). An aluminum pigment (solid content concentration: 20% by weight) in which when the circle equivalent diameter of the pigment particles is measured using a flow-type particle image analyzer FPIA-3000 (manufactured by Sysmex Corporation), the content of the pigment particle having an average circle equivalent diameter of 5.5 μm and a circle equivalent diameter of 4.0 μm or less is 28.5% by number, is obtained.

Preparation of Azo Yellow Pigment Dispersion 1

C.I. Pigment Yellow 74 (manufactured by Dainichiseika Color & Chemicals Mfg. Co., Ltd.: monoazo pigment): 50 parts Ionic surfactant Neogen RK (manufactured by manufactured by Dai-Ichi Kogyo Seiyaku Co., Ltd.): 5 parts Ion exchange water: 192.9 parts The above components are mixed and treated at 240 MPa for 10 minutes using an Ultimizer (manufactured by Sugino Machine, Ltd.), thereby obtaining an azo yellow pigment dispersion (solid content concentration: 20% by weight).

Preparation of Azo Yellow Pigment Dispersion 2

An azo yellow pigment dispersion 2 (solid content concentration: 20% by weight) is obtained in the same manner as in the preparation of the azo yellow pigment dispersion 1 except that the pigment used in the preparation of the azo yellow pigment dispersion 1 is changed to C.I. pigment Yellow 12 (manufactured by Dainichiseika Color & Chemicals Mfg. Co., Ltd.: disazo pigment).

Preparation of Azo Yellow Pigment Dispersion 3

An azo yellow pigment dispersion 3 (solid content concentration: 20% by weight) is obtained in the same manner as in the preparation of the azo yellow pigment dispersion 1 except that the pigment used in the preparation of the azo yellow pigment dispersion 1 is changed to C.I. pigment Yellow 95 (manufactured by Dainichiseika Color & Chemicals Mfg. Co., Ltd.: condensed azo pigment).

Preparation of Magenta Pigment Dispersion 1

A magenta pigment dispersion 1 (solid content concentration: 20% by weight) is obtained in the same manner as in the preparation of the azo yellow pigment dispersion 1 except that the pigment is changed to C.I. Pigment Red 238 (manufactured by Sanyo Chemical Industries, Ltd.) which is a naphthol magenta pigment.

Preparation of Magenta Pigment Dispersion 2

A magenta pigment dispersion 2 (solid content concentration: 20% by weight) is obtained in the same manner as in the preparation of the azo yellow pigment dispersion 1 except that the pigment is changed to C.I. Pigment Red 122 (manufactured by Dainichiseika Color & Chemicals Mfg. Co., Ltd.) which is a quinacridone magenta pigment.

Synthesis of Binder Resin

Dimethyl adipate: 74 parts

Dimethyl terephthalate: 192 parts

Ethylene oxide adduct of bisphenol A: 216 parts

Ethylene glycol: 38 parts

Tetrabutoxy titanate (catalyst): 0.037 parts

The above components are put into a heat-dried two-necked flask, and the temperature is increased while the components are stirred in an inert atmosphere with a nitrogen gas supplied to the container. Then, the obtained material is subjected to a co-condensation polymerization reaction for 7 hours at 160° C., and then while the pressure is slowly reduced to 10 Torr, the temperature is increased to 220° C. and the material is held for 4 hours. The pressure is returned to the ordinary pressure, and 9 parts of trimellitic anhydride is added. The pressure is slowly reduced again to 10 Torr, and the material is held for 1 hour at 220° C., whereby a binder resin is synthesized.

The glass transition temperature (Tg) of the binder resin is obtained through the measurement under the condition of a temperature rise rate of 10° C./min from room temperature (25° C.) to 150° C. by using a differential scanning calorimeter (manufactured by Shimadzu Corporation: DSC-50). A temperature at an intersection point between extended lines of the base line and the rising line in the heat-absorbing part is set as the glass transition temperature. The glass transition temperature of the binder resin is 63.5° C.

Preparation of Resin Particle Dispersion

Binder resin: 160 parts

Ethyl acetate: 233 parts

Sodium hydroxide aqueous solution (0.3 N): 0.1 part

The above components are put into a 1,000 ml separable flask, heated at 70° C., and stirred using a three-one motor (manufactured by Shinto Scientific Co., Ltd.) to prepare a resin mixture. While the resin mixture is further stirred at 90 rpm, 373 parts of ion exchange water is slowly added thereto to perform phase inversion emulsification, and the solvent is removed. Thus, a resin particle dispersion (solid content concentration: 30%) is obtained. The volume average particle diameter of the resin particle dispersion is 162 nm.

Preparation of Release Agent Dispersion

Carnauba wax (manufactured by Toa Kasei Co., Ltd., RC-160): 50 parts

Anionic Surfactant (manufactured by Dai-Ichi Kogyo Seiyaku Co., Ltd., Neogen RK): 1.0 part Ion exchange water: 200 parts The above components are mixed and heated at 95° C. and the mixture is dispersed using a homogenizer (manufactured by IKA-Werke GmbH & Co. KG, Ultra-Turrax T50). Then, a dispersion is performed for 360 minutes using a Manton Gaulin high-pressure homogenizer (manufactured by Gaulin Corporation) to prepare a release agent dispersion (solid content concentration: 20%) in which release agent particles having a volume average particle diameter of 0.23 μm are dispersed.

Preparation of Toner 1

Binder resin dispersion: 411 parts

Release agent dispersion: 63.9 parts

Brilliant pigment dispersion 1: 183.5 parts

Azo yellow pigment dispersion 1: 50 parts

Magenta pigment dispersion 1: 5 parts

Nonionic surfactant (IGEPAL CA897): 1.40 parts

The above raw materials are put into a 2-liter cylindrical stainless-steel container, and dispersed and mixed for 10 minutes using a homogenizer (manufactured by Ika-Werke GmbH & Co. KG, Ultra-Turrax T50) at 4,000 rpm while applying a shearing force. Next, 1.75 parts of a 10% aqueous nitric acid solution of polyaluminum chloride is slowly added dropwise as a coagulant to the mixture, and the mixture is dispersed and mixed for 15 minutes at a number of rotations of the homogenizer of 5,000 rpm. Thus, a raw material dispersion is prepared.

Thereafter, the raw material dispersion is transferred to a polymerization vessel provided with a thermometer and a stirrer having a stirring blade having two paddles for forming a laminar flow. Heating is started by a mantle heater at a number of stirring rotations of 810 rpm to promote the growth of aggregated particles at 54° C. In this case, the pH of the raw material dispersion is controlled to fall in a range of 2.2 to 3.5 with a 0.3 N aqueous nitric acid solution or a 1N aqueous sodium hydroxide solution. The raw material dispersion is kept for about 2 hours at a pH in the above range to form aggregated particles.

Next, 200 parts of the binder resin particle dispersion is further added thereto to attach the resin particles of the binder resin to surfaces of the aggregated particles. The temperature is further increased to 56° C., and the aggregated particles are aligned while the size of the particles is confirmed with an optical microscope and a Multisizer II. Thereafter, in order to cause the aggregated particles to coalesce, the pH is increased to 8.0, and then the temperature is increased to 67.5° C. After the coalescence of the aggregated particles is confirmed with the optical microscope, the pH is decreased to 6.0 while the temperature is maintained at 67.5° C. After 1 hour, the heating is stopped and the particles are cooled at a temperature drop rate of 1.0° C./min. Thereafter, the particles are sieved through a 20 μm mesh, repeatedly washed with water, and then dried by a vacuum dryer, thereby obtaining toner particles. The volume average particle diameter of the obtained toner particles 1 is 12.2 μm.

1.5 parts of hydrophobic silica (manufactured by Nippon Aerosil Co., Ltd., RY50) with 100 parts of the obtained toner particles is mixed using a Henschel mixer at a peripheral velocity of 20 m/s for 3 minutes. Thereafter, the mixture is sieved through a vibrating screen having openings of 45 μm to prepare a toner 1.

Preparation of Carrier

Toluene: 14 parts

Styrene-methyl methacrylate copolymer (component ratio: 80/20, weight average molecular weight: 70,000): 2 parts MZ500 (zinc oxide, manufactured by manufactured by Titan Kogyo, Ltd.): 0.6 parts The above components are mixed and stirred with a stirrer for 10 minutes. Then, a coating layer forming solution in which zinc oxide is dispersed is prepared. Next, this coating solution and 100 parts of ferrite particles (volume average particle diameter: 38 μm) are put into a vacuum deaeration type kneader, and stirred for 30 minutes at 60° C., and the pressure us further reduced and deaerated while heating the mixture, and dried. As a result, a carrier is prepared.

Preparation of Developer 100 parts of the obtained carrier and 8 parts of the toner are mixed using a 2-liter V-blender to prepare a developer 1.

Analysis

Analysis of Brilliant Pigment in Toner 20 g of a toner and 200 ml of toluene are mixed and stirred and the mixture is subjected to solid-liquid separation after the toner resin is sufficiently dissolved in a solvent. Thus, only a brilliant pigment is extracted. The extracted pigment particles are dispersed in water and the circle equivalent diameter thereof is measured using FPIA-3000 (manufactured by Sysmex Corporation).

Analysis of Azo Yellow Pigment and Magenta Pigment in Toner

About 10 mg of a toner is accurately weighed and the toner is dissolved in toluene to prepare 10 ml of a toluene solution. After being kept for 12 hours or more, a brilliant pigment is settled and some of the supernatant is distilled. Then, the type of the pigment is specified from the infrared absorption spectrum of a residue. More specifically, the unique absorption wavelengths of the azo yellow pigment and the magenta pigment are measured in advance and the type of the pigment in the residue is specified. Further, the amount of the pigment is obtained by measuring the ultraviolet absorption spectrum of the supernatant according to the Lambert-Beer's law. Specifically, when the absorption coefficient of each pigment is measured based on a relationship between the intensity of an endothermic peak of a specific wavelength and the concentration and then the ultraviolet absorption spectrum of a sample is obtained, the concentration of the pigment is measured based on the height of the wavelength.

Preparation of Toners 2 to 65

Toners 1 to 65 and developers 1 to 65 are prepared in the same manner as in the preparation of the toner 1 except that the binder resin dispersion, the release agent dispersion, the brilliant pigment dispersion 1, the azo yellow pigment dispersion 1, the magenta pigment dispersion 1, and a binder resin dispersion to be added are changed as shown in Tables 1 and 2.

Preparation of Toners 66 to 104

Toners 66 to 104 and developers 66 to 104 are prepared in the same manner as in the preparation of the toner 1 except that the binder resin dispersion, the release agent dispersion, the brilliant pigment dispersion 1, the azo yellow pigment dispersion, the magenta pigment dispersion, and a binder resin dispersion to be added are changed as shown in Table 3.

Preparation of Toner 105

A toner 105 and a developer 105 are prepared in the same manner as in the preparation of the toner 1 except that a brilliant pigment dispersion 2 is used.

Preparation of Toner 106

A toner 106 and a developer 106 are prepared in the same manner as in the preparation of the toner 1 except that a brilliant pigment dispersion 3 is used.

TABLE 1

| | Binder resin | Release agent | Brilliant pigment | Azo yellow pigment | | Magenta Pigment | | Binder resin dispersion |
|---|---|---|---|---|---|---|---|---|
| | dispersion | dispersion | dispersion | Dispersion | Amount | Dispersion | Amount | to be added |
| Toner 1 | 411 | 63.9 | 183.5 | 1 | 50 | 1 | 5 | 200 |
| Toner 2 | 356 | 47.7 | 136.5 | 1 | 36 | 1 | 5 | 100 |
| Toner 3 | 678 | 91.9 | 263.5 | 1 | 74 | 1 | 5 | 200 |
| Toner 4 | 334 | 45.4 | 130 | 1 | 34 | 1 | 5 | 100 |
| Toner 5 | 244 | 36.0 | 103 | 1 | 26 | 1 | 5 | 100 |
| Toner 6 | 700 | 94.2 | 270 | 1 | 76 | 1 | 5 | 200 |
| Toner 7 | 850 | 120.3 | 345 | 1 | 98.5 | 1 | 5 | 300 |
| Toner 8 | 222 | 33.7 | 97 | 1 | 24 | 1 | 5 | 100 |
| Toner 9 | 169 | 25.0 | 72 | 1 | 16.5 | 1 | 5 | 70 |
| Toner 10 | 444 | 62.1 | 178 | 1 | 51 | 1 | 2.5 | 150 |
| Toner 11 | 647 | 88.6 | 254 | 1 | 74 | 1 | 2.5 | 200 |
| Toner 12 | 141 | 22.1 | 63 | 1 | 14 | 1 | 5 | 70 |
| Toner 13 | 675 | 91.6 | 263 | 1 | 76.3 | 1 | 2.5 | 200 |
| Toner 14 | 858 | 84.6 | 55 | 1 | 10 | 1 | 1 | 200 |
| Toner 15 | 588 | 63.0 | 41 | 1 | 7.2 | 1 | 1 | 200 |
| Toner 16 | 1019 | 121.5 | 79 | 1 | 14.8 | 1 | 1 | 500 |
| Toner 17 | 500 | 60.0 | 39 | 1 | 6.8 | 1 | 1 | 250 |
| Toner 18 | 496 | 55.2 | 31 | 1 | 5.2 | 1 | 1 | 200 |
| Toner 19 | 1058 | 124.6 | 81 | 1 | 15.2 | 1 | 1 | 500 |
| Toner 20 | 1290 | 159.1 | 103.5 | 1 | 19.7 | 1 | 1 | 700 |
| Toner 21 | 408 | 44.8 | 31 | 1 | 5.2 | 1 | 1 | 150 |
| Toner 22 | 263 | 33.0 | 21.5 | 1 | 3.3 | 1 | 1 | 150 |
| Toner 23 | 1358 | 164.6 | 107 | 1 | 20.4 | 1 | 1 | 700 |
| Toner 24 | 2033 | 234.5 | 152.5 | 1 | 29.5 | 1 | 1 | 900 |
| Toner 25 | 265 | 29.2 | 19 | 1 | 2.8 | 1 | 1 | 100 |
| Toner 26 | 2029 | 242.2 | 157.5 | 1 | 30.5 | 1 | 1 | 1000 |
| Toner 27 | 187 | 36.1 | 138 | 1 | 50 | 1 | 5 | 100 |
| Toner 28 | 134 | 26.9 | 103 | 1 | 36 | 1 | 5 | 80 |
| Toner 29 | 312 | 51.9 | 198 | 1 | 74 | 1 | 5 | 100 |
| Toner 30 | 123 | 25.6 | 98 | 1 | 34 | 1 | 5 | 80 |
| Toner 31 | 101 | 20.3 | 77.5 | 1 | 26 | 1 | 5 | 60 |
| Toner 32 | 322 | 53.1 | 203 | 1 | 76 | 1 | 5 | 100 |
| Toner 33 | 389 | 67.9 | 259 | 1 | 98.5 | 1 | 5 | 150 |

TABLE 2

| | Binder resin | Release agent | Brilliant pigment | Azo yellow pigment | | Magenta Pigment | | Binder resin dispersion |
|---|---|---|---|---|---|---|---|---|
| | dispersion | dispersion | dispersion | Dispersion | Amount | Dispersion | Amount | to be added |
| Toner 34 | 101 | 19.0 | 72.5 | 1 | 24 | 1 | 5 | 50 |
| Toner 35 | 82 | 14.1 | 54 | 1 | 16.5 | 1 | 5 | 30 |
| Toner 36 | 357 | 70.1 | 267 | 1 | 102 | 1 | 5 | 200 |
| Toner 37 | 594 | 99.9 | 381 | 1 | 147.5 | 1 | 5 | 200 |
| Toner 38 | 69 | 12.5 | 47.5 | 1 | 14 | 1 | 5 | 30 |
| Toner 39 | 620 | 103.2 | 394 | 1 | 152.5 | 1 | 5 | 200 |
| Toner 40 | 1328 | 121.4 | 73.5 | 1 | 10 | 1 | 1 | 200 |
| Toner 41 | 939 | 90.4 | 54 | 1 | 7.2 | 1 | 1 | 200 |
| Toner 42 | 1694 | 174.2 | 105 | 1 | 14.8 | 1 | 1 | 500 |
| Toner 43 | 833 | 86.0 | 52 | 1 | 6.8 | 1 | 1 | 250 |
| Toner 44 | 661 | 68.4 | 41 | 1 | 5.2 | 1 | 1 | 200 |
| Toner 45 | 1750 | 178.7 | 108 | 1 | 15.2 | 1 | 1 | 500 |
| Toner 46 | 2175 | 228.3 | 138 | 1 | 19.7 | 1 | 1 | 700 |
| Toner 47 | 656 | 64.1 | 40 | 1 | 5.2 | 1 | 1 | 150 |
| Toner 48 | 447 | 47.4 | 28 | 1 | 3.3 | 1 | 1 | 150 |
| Toner 49 | 2272 | 236.1 | 143 | 1 | 20.4 | 1 | 1 | 700 |
| Toner 50 | 3336 | 336.4 | 203 | 1 | 29.5 | 1 | 1 | 900 |
| Toner 51 | 428 | 41.9 | 25 | 1 | 2.8 | 1 | 1 | 100 |
| Toner 52 | 3375 | 347.5 | 210 | 1 | 30.5 | 1 | 1 | 1000 |
| Toner 53 | 112 | 28.4 | 110 | 1 | 50 | 1 | 5 | 100 |
| Toner 54 | 78 | 21.2 | 82 | 1 | 36 | 1 | 5 | 80 |
| Toner 55 | 204 | 40.7 | 158 | 1 | 74 | 1 | 5 | 100 |
| Toner 56 | 70 | 20.1 | 78 | 1 | 34 | 1 | 5 | 80 |
| Toner 57 | 59 | 16.0 | 62 | 1 | 26 | 1 | 5 | 60 |
| Toner 58 | 212 | 41.8 | 162 | 1 | 76 | 1 | 5 | 100 |
| Toner 59 | 248 | 53.3 | 207 | 1 | 98.5 | 1 | 5 | 150 |
| Toner 60 | 62 | 15.0 | 58 | 1 | 24 | 1 | 5 | 50 |
| Toner 61 | 53 | 11.1 | 43 | 1 | 16.5 | 1 | 5 | 30 |
| Toner 62 | 212 | 55.2 | 214 | 1 | 102 | 1 | 5 | 200 |
| Toner 63 | 387 | 78.6 | 305 | 1 | 147.5 | 1 | 5 | 200 |
| Toner 64 | 43 | 9.8 | 38 | 1 | 14 | 1 | 5 | 30 |
| Toner 65 | 406 | 81.2 | 315 | 1 | 152.5 | 1 | 5 | 200 |

TABLE 3

| | Binder resin | Release agent | Brilliant pigment | Azo yellow pigment | | Magenta Pigment | | Binder resin dispersion |
|---|---|---|---|---|---|---|---|---|
| | dispersion | dispersion | dispersion | Dispersion | Amount | Dispersion | Amount | to be added |
| Toner 66 | 411 | 63.9 | 183.5 | 2 | 50 | 1 | 5 | 200 |
| Toner 67 | 356 | 47.7 | 136.5 | 2 | 36 | 1 | 5 | 100 |
| Toner 68 | 678 | 91.9 | 263.5 | 2 | 74 | 1 | 5 | 200 |
| Toner 69 | 334 | 45.4 | 130 | 2 | 34 | 1 | 5 | 100 |
| Toner 70 | 244 | 36.0 | 103 | 2 | 26 | 1 | 5 | 100 |
| Toner 71 | 700 | 94.2 | 270 | 2 | 76 | 1 | 5 | 200 |
| Toner 72 | 850 | 120.3 | 345 | 2 | 98.5 | 1 | 5 | 300 |
| Toner 73 | 222 | 33.7 | 97 | 2 | 24 | 1 | 5 | 100 |
| Toner 74 | 169 | 25.0 | 72 | 2 | 16.5 | 1 | 5 | 70 |
| Toner 75 | 444 | 62.1 | 178 | 2 | 51 | 1 | 2.5 | 150 |
| Toner 76 | 647 | 88.6 | 254 | 2 | 74 | 1 | 2.5 | 200 |
| Toner 77 | 141 | 22.1 | 63 | 2 | 14 | 1 | 5 | 70 |
| Toner 78 | 675 | 91.6 | 263 | 2 | 76.3 | 1 | 2.5 | 200 |
| Toner 79 | 411 | 63.9 | 183.5 | 3 | 50 | 1 | 5 | 200 |
| Toner 80 | 356 | 47.7 | 136.5 | 3 | 36 | 1 | 5 | 100 |
| Toner 81 | 678 | 91.9 | 263.5 | 3 | 74 | 1 | 5 | 200 |
| Toner 82 | 334 | 45.4 | 130 | 3 | 34 | 1 | 5 | 100 |
| Toner 83 | 244 | 36.0 | 103 | 3 | 26 | 1 | 5 | 100 |
| Toner 84 | 700 | 94.2 | 270 | 3 | 76 | 1 | 5 | 200 |
| Toner 85 | 850 | 120.3 | 345 | 3 | 98.5 | 1 | 5 | 300 |
| Toner 86 | 222 | 33.7 | 97 | 3 | 24 | 1 | 5 | 100 |
| Toner 87 | 169 | 25.0 | 72 | 3 | 16.5 | 1 | 5 | 70 |
| Toner 88 | 444 | 62.1 | 178 | 3 | 51 | 1 | 2.5 | 150 |
| Toner 89 | 647 | 88.6 | 254 | 3 | 74 | 1 | 2.5 | 200 |
| Toner 90 | 141 | 22.1 | 63 | 3 | 14 | 1 | 5 | 70 |
| Toner 91 | 675 | 91.6 | 263 | 3 | 76.3 | 1 | 2.5 | 200 |
| Toner 92 | 411 | 63.9 | 183.5 | 2 | 50 | 2 | 5 | 200 |
| Toner 93 | 356 | 47.7 | 136.5 | 2 | 36 | 2 | 5 | 100 |
| Toner 94 | 678 | 91.9 | 263.5 | 2 | 74 | 2 | 5 | 200 |
| Toner 95 | 334 | 45.4 | 130 | 2 | 34 | 2 | 5 | 100 |
| Toner 96 | 244 | 36.0 | 103 | 2 | 26 | 2 | 5 | 100 |
| Toner 97 | 700 | 94.2 | 270 | 2 | 76 | 2 | 5 | 200 |

TABLE 3-continued

| | Binder resin | Release agent | Brilliant pigment | Azo yellow pigment | | Magenta Pigment | | Binder resin dispersion |
|---|---|---|---|---|---|---|---|---|
| | dispersion | dispersion | dispersion | Dispersion | Amount | Dispersion | Amount | to be added |
| Toner 98 | 850 | 120.3 | 345 | 2 | 98.5 | 2 | 5 | 300 |
| Toner 99 | 222 | 33.7 | 97 | 2 | 24 | 2 | 5 | 100 |
| Toner 100 | 169 | 25.0 | 72 | 2 | 16.5 | 2 | 5 | 70 |
| Toner 101 | 444 | 62.1 | 178 | 2 | 51 | 2 | 2.5 | 150 |
| Toner 102 | 647 | 88.6 | 254 | 2 | 74 | 2 | 2.5 | 200 |
| Toner 103 | 141 | 22.1 | 63 | 2 | 14 | 2 | 5 | 70 |
| Toner 104 | 675 | 91.6 | 263 | 2 | 76.3 | 2 | 2.5 | 200 |

Evaluation

A DocuCentre-III C7600, manufactured by Fuji Xerox Co., Ltd., is filled with the developers 1 to 106 as samples, and a solid image in which the toner applied amount is 4.0 g/cm$^2$ is formed on a recording sheet (an OK top-coated+sheet of paper, manufactured by Oji Paper Co., Ltd.) at a fixing temperature of 180° C. with a fixing pressure of 4.0 kgf/cm$^2$.

Evaluation of Lightness, Color Saturation, and Hue Angle

The measurement is performed at random 10 positions in the image plane using X-Rite 939 (aperture: 4 mm, manufactured by X-Rite) and the average value is set as a color gamut (L*a*b). A color saturation (C*) and a hue angle (H) are calculated by the following equations based on the obtained color gamut (L*a*b).

$$C^*=((a^*)^2+(b^*)^2)^{1/2}$$

$$H=\tan^{-1}(b^*/a^*)$$

The evaluation results are shown in Tables 4 and 5.

Evaluation of Brilliance

The brilliance is visually evaluated under illumination for color observation (natural daylight illumination) based on "testing methods for paints, Part 4: visual characteristics of film, Section 3: visual comparison of the color of paints" in JIS K5600-4-3: 1999. A particle feeling (shining brilliance effect) and an optical effect (change in the hue depending on the angle of view) are evaluated with the following standards. Level 2 or higher levels are determined practically usable level. The evaluation results are shown in Tables 4 and 5.

4: The particle feeling and the optical effect are harmonized.

3: The particle feeling and the optical effect are slightly observed.

2: Normal feeling.

1: There are no particle feeling and no optical effect.

Evaluation of Gold Color Reproducibility

A DocuCentre-III C7600, manufactured by Fuji Xerox Co., Ltd., is filled with a developer as a sample, and a solid image in which the toner applied amount is 3.5 g/cm$^2$ is formed on yellow fluorescent paper at a fixing temperature of 180° C. with a fixing pressure of 4.0 kgf/cm$^2$.

The gold color reproducibility is instinctively evaluated through visual observation under illumination for color observation (natural daylight illumination) based on "testing methods for paints, Part 4: visual characteristics of film, Section 3: visual comparison of the color of paints" in JIS K5600-4-3: 1999. Level 2 or higher levels are determined practically usable level. The evaluation results are shown in Tables 4 and 5.

3: Brilliant gold color

2: Normal gold color

1: Reddish or deep yellowish, or dull gold color

TABLE 4

| | | Brilliant pigment | | | | YM Pigment | | | | | | |
|---|---|---|---|---|---|---|---|---|---|---|---|---|
| | | Circle equivalent diameter (μm) | Content of particles of 4.0 μm or less (%) | Yellow pigment Type | Magenta pigment Type | amounts with respect to brilliant pigment (parts by weight) | Y:M Pigment ratio | Color saturation C* | Hue angle H | Light-ness L* | Bril-liance | Gold color reproduc-ibility |
| Example 1 | Toner 1 | 6 | 8.9 | PY74 | PR238 | 30.0 | 10:1 | 37.8 | 72.3 | 73.3 | 4 | 3 |
| Example 2 | Toner 2 | 6 | 8.9 | PY74 | PR238 | 30.0 | 7.3:1 | 37.9 | 69.2 | 73.2 | 4 | 3 |
| Example 3 | Toner 3 | 6 | 8.9 | PY74 | PR238 | 30.0 | 14.8:1 | 37.8 | 77.9 | 73.3 | 4 | 3 |
| Example 4 | Toner 4 | 6 | 8.9 | PY74 | PR238 | 30.0 | 6.8:1 | 37.9 | 68.6 | 70.7 | 4 | 3 |
| Example 5 | Toner 5 | 6 | 8.9 | PY74 | PR238 | 30.1 | 5.2:1 | 37.9 | 66.8 | 70.5 | 4 | 3 |
| Example 6 | Toner 6 | 6 | 8.9 | PY74 | PR238 | 30.0 | 15.2:1 | 37.9 | 78.3 | 70.8 | 4 | 3 |
| Example 7 | Toner 7 | 6 | 8.9 | PY74 | PR238 | 30.0 | 19.7:1 | 37.9 | 83.5 | 70.4 | 4 | 3 |
| Example 8 | Toner 8 | 6 | 8.9 | PY74 | PR238 | 29.9 | 4.8:1 | 37.8 | 66.3 | 68.2 | 4 | 2 |
| Example 9 | Toner 9 | 6 | 8.9 | PY74 | PR238 | 29.9 | 3.3:1 | 37.7 | 65.2 | 68.1 | 4 | 2 |
| Example 10 | Toner 10 | 6 | 8.9 | PY74 | PR238 | 30.1 | 20.4:1 | 37.9 | 84.3 | 68.5 | 4 | 2 |
| Example 11 | Toner 11 | 6 | 8.9 | PY74 | PR238 | 30.1 | 29.6:1 | 38.0 | 94.9 | 68.3 | 4 | 2 |
| Comparative example 1 | Toner 12 | 6 | 8.9 | PY74 | PR238 | 30.2 | 2.8:1 | 38.0 | 64.1 | 66.2 | 4 | 1 |
| Comparative example 2 | Toner 13 | 6 | 8.9 | PY74 | PR238 | 30.0 | 30.5:1 | 37.8 | 96.3 | 65.9 | 4 | 1 |
| Example 12 | Toner 14 | 6 | 8.9 | PY74 | PR238 | 20.0 | 10:1 | 29.3 | 72.3 | 69.9 | 3 | 2 |
| Example 13 | Toner 15 | 6 | 8.9 | PY74 | PR238 | 20.0 | 7.3:1 | 29.3 | 69.2 | 69.8 | 3 | 2 |
| Example 14 | Toner 16 | 6 | 8.9 | PY74 | PR238 | 20.0 | 14.8:1 | 29.3 | 77.9 | 69.9 | 3 | 2 |
| Example 15 | Toner 17 | 6 | 8.9 | PY74 | PR238 | 20.0 | 6.8:1 | 29.3 | 68.6 | 67.5 | 3 | 2 |
| Example 16 | Toner 18 | 6 | 8.9 | PY74 | PR238 | 20.0 | 5.2:1 | 29.3 | 66.8 | 67.6 | 3 | 2 |
| Example 17 | Toner 19 | 6 | 8.9 | PY74 | PR238 | 20.0 | 15.2:1 | 29.3 | 78.3 | 67.3 | 3 | 2 |
| Example 18 | Toner 20 | 6 | 8.9 | PY74 | PR238 | 20.0 | 19.7:1 | 29.3 | 83.5 | 67.5 | 3 | 2 |

TABLE 4-continued

| | | Brilliant pigment | | | | YM Pigment | | | | | | |
|---|---|---|---|---|---|---|---|---|---|---|---|---|
| | | Circle equivalent diameter (μm) | Content of particles of 4.0 μm or less (%) | Yellow pigment Type | Magenta pigment Type | amounts with respect to brilliant pigment (parts by weight) | Y:M Pigment ratio | Color saturation C* | Hue angle H | Light-ness L* | Bril-liance | Gold color reproduc-ibility |
| Example 19 | Toner 21 | 6 | 8.9 | PY74 | PR238 | 20.0 | 4.8:1 | 29.3 | 66.3 | 64.6 | 3 | 2 |
| Example 20 | Toner 22 | 6 | 8.9 | PY74 | PR238 | 20.0 | 3.3:1 | 29.3 | 65.2 | 64.8 | 3 | 2 |
| Example 21 | Toner 23 | 6 | 8.9 | PY74 | PR238 | 20.0 | 20.4:1 | 29.3 | 84.3 | 64.6 | 3 | 2 |
| Example 22 | Toner 24 | 6 | 8.9 | PY74 | PR238 | 20.0 | 29.6:1 | 29.3 | 94.9 | 64.7 | 3 | 2 |
| Comparative example 3 | Toner 25 | 6 | 8.9 | PY74 | PR238 | 20.0 | 2.8:1 | 29.3 | 64.1 | 62.3 | 3 | 1 |
| Comparative example 4 | Toner 26 | 6 | 8.9 | PY74 | PR238 | 20.0 | 30.5:1 | 29.3 | 96.3 | 62.2 | 3 | 1 |
| Example 23 | Toner 27 | 6 | 8.9 | PY74 | PR238 | 39.9 | 10:1 | 46.3 | 72.3 | 74.5 | 4 | 3 |
| Example 24 | Toner 28 | 6 | 8.9 | PY74 | PR238 | 39.8 | 7.3:1 | 46.3 | 69.2 | 74.5 | 4 | 3 |
| Example 25 | Toner 29 | 6 | 8.9 | PY74 | PR238 | 39.9 | 14.8:1 | 46.3 | 77.9 | 74.1 | 4 | 3 |
| Example 26 | Toner 30 | 6 | 8.9 | PY74 | PR238 | 39.8 | 6.8:1 | 46.3 | 68.6 | 72.1 | 4 | 3 |
| Example 27 | Toner 31 | 6 | 8.9 | PY74 | PR238 | 40.0 | 5.2:1 | 46.4 | 66.8 | 71.8 | 4 | 3 |
| Example 28 | Toner 32 | 6 | 8.9 | PY74 | PR238 | 39.9 | 15.2:1 | 46.3 | 78.3 | 71.7 | 4 | 3 |
| Example 29 | Toner 33 | 6 | 8.9 | PY74 | PR238 | 40.0 | 19.7:1 | 46.4 | 83.5 | 72 | 4 | 3 |
| Example 30 | Toner 34 | 6 | 8.9 | PY74 | PR238 | 40.0 | 4.8:1 | 46.4 | 66.3 | 68.3 | 4 | 2 |
| Example 31 | Toner 35 | 6 | 8.9 | PY74 | PR238 | 39.8 | 3.3:1 | 46.3 | 65.2 | 68.3 | 4 | 2 |
| Example 32 | Toner 36 | 6 | 8.9 | PY74 | PR238 | 40.1 | 20.4:1 | 46.5 | 84.3 | 68.5 | 4 | 2 |
| Example 33 | Toner 37 | 6 | 8.9 | PY74 | PR238 | 40.0 | 29.6:1 | 46.4 | 94.9 | 68.6 | 4 | 2 |
| Comparative example 5 | Toner 38 | 6 | 8.9 | PY74 | PR238 | 40.0 | 2.8:1 | 46.4 | 64.4 | 66.3 | 4 | 1 |
| Comparative example 6 | Toner 39 | 6 | 8.9 | PY74 | PR238 | 40.0 | 30.5:1 | 46.4 | 96.3 | 66.5 | 4 | 1 |
| Example 34 | Toner 40 | 6 | 8.9 | PY74 | PR238 | 15.0 | 10:1 | 25.0 | 72.3 | 68.8 | 2 | 2 |
| Example 35 | Toner 41 | 6 | 8.9 | PY74 | PR238 | 15.2 | 7.3:1 | 25.2 | 69.2 | 68.2 | 2 | 2 |
| Example 36 | Toner 42 | 6 | 8.9 | PY74 | PR238 | 15.0 | 14.8:1 | 25.0 | 77.9 | 68.3 | 2 | 2 |
| Example 37 | Toner 43 | 6 | 8.9 | PY74 | PR238 | 15.0 | 6.8:1 | 25.0 | 68.6 | 66.1 | 2 | 2 |
| Example 38 | Toner 44 | 6 | 8.9 | PY74 | PR238 | 15.1 | 5.2:1 | 25.1 | 66.8 | 66.3 | 2 | 2 |
| Example 39 | Toner 45 | 6 | 8.9 | PY74 | PR238 | 15.0 | 15.2:1 | 25.0 | 78.3 | 66.1 | 2 | 2 |
| Example 40 | Toner 46 | 6 | 8.9 | PY74 | PR238 | 15.0 | 19.7:1 | 25.0 | 83.5 | 66 | 2 | 2 |
| Example 41 | Toner 47 | 6 | 8.9 | PY74 | PR238 | 15.5 | 4.8:1 | 25.4 | 66.3 | 64.1 | 2 | 2 |
| Example 42 | Toner 48 | 6 | 8.9 | PY74 | PR238 | 15.4 | 3.3:1 | 25.3 | 65.2 | 63.8 | 2 | 2 |
| Example 43 | Toner 49 | 6 | 8.9 | PY74 | PR238 | 15.0 | 20.4:1 | 25.0 | 84.3 | 64 | 2 | 2 |
| Example 44 | Toner 50 | 6 | 8.9 | EY74 | PR238 | 15.0 | 29.6:1 | 25.0 | 94.9 | 63.7 | 2 | 2 |
| Comparative example 7 | Toner 51 | 6 | 8.9 | PY74 | PR238 | 15.2 | 2.8:1 | 24.8 | 64.1 | 61.1 | 2 | 1 |
| Comparative example 8 | Toner 52 | 6 | 8.9 | PY74 | PR238 | 15.0 | 30.5:1 | 25.0 | 96.3 | 61.2 | 2 | 1 |
| Example 45 | Toner 53 | 6 | 8.9 | PY74 | PR238 | 50.0 | 10:1 | 55.0 | 72.3 | 74.8 | 4 | 3 |

TABLE 5

| | | Brilliant pigment | | | | YM Pigment | | | | | | |
|---|---|---|---|---|---|---|---|---|---|---|---|---|
| | | Circle equivalent diameter (μm) | Content of particles of 4.0 μm or less (%) | Yellow pigment Type | Magenta pigment Type | amounts with respect to brilliant pigment (parts by weight) | Y:M Pigment ratio | Color saturation C* | Hue angle H | Light-ness L* | Bril-liance | Gold color reproduc-ibility |
| Example 46 | Toner 54 | 6 | 8.9 | PY74 | PR238 | 50.0 | 7.3:1 | 55.0 | 69.2 | 74.9 | 4 | 3 |
| Example 47 | Toner 55 | 6 | 8.9 | PY74 | PR238 | 50.0 | 14.8:1 | 55.0 | 77.9 | 74.7 | 4 | 3 |
| Example 48 | Toner 56 | 6 | 8.9 | PY74 | PR238 | 50.0 | 6.8:1 | 55.0 | 68.6 | 72.5 | 4 | 3 |
| Example 49 | Toner 57 | 6 | 8.9 | PY74 | PR238 | 50.0 | 5.2:1 | 55.0 | 66.8 | 72.5 | 4 | 3 |
| Example 50 | Toner 58 | 6 | 8.9 | PY74 | PR238 | 50.0 | 15.2:1 | 55.0 | 78.3 | 72.6 | 4 | 3 |
| Example 51 | Toner 59 | 6 | 8.9 | PY74 | PR238 | 50.0 | 19.7:1 | 55.0 | 83.5 | 72.4 | 4 | 3 |
| Example 52 | Toner 60 | 6 | 8.9 | PY74 | PR238 | 50.0 | 4.8:1 | 55.0 | 66.3 | 69.2 | 4 | 2 |
| Example 53 | Toner 61 | 6 | 8.9 | PY74 | PR238 | 50.0 | 3.3:1 | 55.0 | 64.6 | 69.2 | 4 | 2 |
| Example 54 | Toner 62 | 6 | 8.9 | EY74 | PR238 | 50.0 | 20.4:1 | 55.0 | 84.3 | 69.1 | 4 | 2 |
| Example 55 | Toner 63 | 6 | 8.9 | PY74 | PR238 | 50.0 | 29.6:1 | 55.0 | 94.9 | 69 | 4 | 2 |
| Comparative example 9 | Toner 64 | 6 | 8.9 | PY74 | PR238 | 50.0 | 2.8:1 | 55.0 | 64.1 | 66.6 | 4 | 1 |
| Comparative example 10 | Toner 65 | 6 | 8.9 | PY74 | PR238 | 50.0 | 30.5:1 | 55.0 | 96.3 | 66.7 | 4 | 1 |
| Example 56 | Toner 66 | 6 | 8.9 | PY12 | PR238 | 30.0 | 10:1 | 37.8 | 72.8 | 61.5 | 4 | 3 |
| Example 57 | Toner 67 | 6 | 8.9 | PY12 | PR238 | 30.0 | 7.3:1 | 37.9 | 69.7 | 61.2 | 4 | 3 |
| Example 58 | Toner 68 | 6 | 8.9 | PY12 | PR238 | 30.0 | 14.8:1 | 37.8 | 78.4 | 61.3 | 4 | 3 |
| Example 59 | Toner 69 | 6 | 8.9 | PY12 | PR238 | 30.0 | 6.8:1 | 37.9 | 69.1 | 59.1 | 4 | 3 |
| Example 60 | Toner 70 | 6 | 8.9 | PY12 | PR238 | 30.1 | 5.2:1 | 37.9 | 67.3 | 59 | 4 | 3 |
| Example 61 | Toner 71 | 6 | 8.9 | PY12 | PR238 | 30.0 | 15.2:1 | 37.9 | 78.8 | 59.2 | 4 | 3 |
| Example 62 | Toner 72 | 6 | 8.9 | PY12 | PR238 | 30.0 | 19.7:1 | 37.9 | 84.0 | 58.8 | 4 | 3 |

TABLE 5-continued

| | | Brilliant pigment | | | | YM Pigment | | | | | | |
|---|---|---|---|---|---|---|---|---|---|---|---|---|
| | | Circle equivalent diameter (μm) | Content of particles of 4.0 μm or less (%) | Yellow pigment Type | Magenta pigment Type | amounts with respect to brilliant pigment (parts by weight) | Y:M Pigment ratio | Color saturation C* | Hue angle H | Light-ness L* | Bril-liance | Gold color reproduc-ibility |
| Example 63 | Toner 73 | 6 | 8.9 | PY12 | PR238 | 29.9 | 4.8:1 | 37.8 | 66.8 | 55.5 | 4 | 2 |
| Example 64 | Toner 74 | 6 | 8.9 | PY12 | PR238 | 29.9 | 3.3:1 | 37.7 | 65.1 | 55.5 | 4 | 2 |
| Example 65 | Toner 75 | 6 | 8.9 | PY12 | PR238 | 30.1 | 20.4:1 | 37.9 | 84.8 | 55.3 | 4 | 2 |
| Example 66 | Toner 76 | 6 | 8.9 | PY12 | PR238 | 30.1 | 29.6:1 | 38.0 | 94.4 | 55.2 | 4 | 2 |
| Comparative example 11 | Toner 77 | 6 | 8.9 | PY12 | PR238 | 30.2 | 2.8:1 | 38.0 | 64.6 | 52.8 | 4 | 1 |
| Comparative example 12 | Toner 78 | 6 | 8.9 | PY12 | PR238 | 30.0 | 30.5:1 | 37.8 | 96.8 | 52.6 | 4 | 1 |
| Example 67 | Toner 79 | 6 | 8.9 | PY95 | PR238 | 30.0 | 10:1 | 37.8 | 73.3 | 61.2 | 4 | 3 |
| Example 68 | Toner 80 | 6 | 8.9 | PY95 | PR238 | 30.0 | 7.3:1 | 37.9 | 70.2 | 60.9 | 4 | 3 |
| Example 69 | Toner 81 | 6 | 8.9 | PY95 | PR238 | 30.0 | 14.8:1 | 37.8 | 78.9 | 61.1 | 4 | 3 |
| Example 70 | Toner 82 | 6 | 8.9 | PY95 | PR238 | 30.0 | 6.8:1 | 37.9 | 69.6 | 58.5 | 4 | 3 |
| Example 71 | Toner 83 | 6 | 8.9 | PY95 | PR238 | 30.1 | 5.2:1 | 37.9 | 67.8 | 58.5 | 4 | 3 |
| Example 72 | Toner 84 | 6 | 8.9 | PY95 | PR238 | 30.0 | 15.2:1 | 37.9 | 79.3 | 58.1 | 4 | 3 |
| Example 73 | Toner 85 | 6 | 8.9 | PY95 | PR238 | 30.0 | 19.7:1 | 37.9 | 84.5 | 58.3 | 4 | 3 |
| Example 74 | Toner 86 | 6 | 8.9 | PY95 | PR238 | 29.9 | 4.8:1 | 37.8 | 67.3 | 56.1 | 4 | 2 |
| Example 75 | Toner 87 | 6 | 8.9 | PY95 | PR238 | 29.9 | 3.3:1 | 37.7 | 65.6 | 56 | 4 | 2 |
| Example 76 | Toner 88 | 6 | 8.9 | PY95 | PR238 | 30.1 | 20.4:1 | 37.9 | 85.3 | 55.7 | 4 | 2 |
| Example 77 | Toner 89 | 6 | 8.9 | PY95 | PR238 | 30.1 | 29.6:1 | 38.0 | 94.9 | 56.3 | 4 | 2 |
| Comparative example 13 | Toner 90 | 6 | 8.9 | PY95 | PR238 | 30.2 | 2.8:1 | 38.0 | 64.8 | 52.1 | 4 | 1 |
| Comparative example 14 | Toner 91 | 6 | 8.9 | PY95 | PR238 | 30.0 | 30.5:1 | 37.8 | 97.3 | 52.2 | 4 | 1 |
| Example 78 | Toner 92 | 6 | 8.9 | PY12 | PR122 | 30.0 | 10:1 | 37.8 | 74.3 | 54.3 | 4 | 3 |
| Example 79 | Toner 93 | 6 | 8.9 | PY12 | PR122 | 30.0 | 7.3:1 | 37.9 | 71.2 | 54.3 | 4 | 3 |
| Example 80 | Toner 94 | 6 | 8.9 | PY12 | PR122 | 30.0 | 14.8:1 | 37.8 | 79.9 | 54.5 | 4 | 3 |
| Example 81 | Toner 95 | 6 | 8.9 | PY12 | PR122 | 30.0 | 6.8:1 | 37.9 | 70.6 | 51.2 | 4 | 3 |
| Example 82 | Toner 96 | 6 | 8.9 | PY12 | PR122 | 30.1 | 5.2:1 | 37.9 | 68.8 | 51.3 | 4 | 3 |
| Example 83 | Toner 97 | 6 | 8.9 | PY12 | PR122 | 30.0 | 15.2:1 | 37.9 | 80.3 | 51.7 | 4 | 3 |
| Example 84 | Toner 98 | 6 | 8.9 | PY12 | PR122 | 30.0 | 19.7:1 | 37.9 | 85.5 | 51.6 | 4 | 3 |
| Example 85 | Toner 99 | 6 | 8.9 | PY12 | PR122 | 29.9 | 4.8:1 | 37.8 | 68.3 | 50.1 | 4 | 2 |
| Example 86 | Toner 100 | 6 | 8.9 | PY12 | PR122 | 29.9 | 3.3:1 | 37.7 | 66.6 | 50.1 | 4 | 2 |
| Example 87 | Toner 101 | 6 | 8.9 | PY12 | PR122 | 30.1 | 20.4:1 | 37.9 | 86.3 | 50.3 | 4 | 2 |
| Example 88 | Toner 102 | 6 | 8.9 | PY12 | PR122 | 30.1 | 29.6:1 | 38.0 | 94.9 | 50.1 | 4 | 2 |
| Comparative example 15 | Toner 103 | 6 | 8.9 | PY12 | PR122 | 30.2 | 2.8:1 | 38.0 | 66.1 | 48.4 | 4 | 1 |
| Comparative example 16 | Toner 104 | 6 | 8.9 | PY12 | PR122 | 30.0 | 30.5:1 | 37.8 | 98.3 | 48.1 | 4 | 1 |
| Example 89 | Toner 105 | 5.8 | 10.7 | PY74 | PR238 | 30.0 | 10:1 | 37.9 | 74.8 | 55.6 | 4 | 3 |
| Comparative example 17 | Toner 106 | 5.5 | 28.5 | PY74 | PR238 | 30.0 | 10:1 | 22.5 | 62.0 | 45.1 | 4 | 2 |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A brilliant toner comprising:

a brilliant pigment comprising:

a metal pigment, a first coating layer that coats a surface of the metal pigment and includes at least one metal oxide selected from the group consisting of silica, alumina, and titania, and a second coating layer that coats a surface of the first coating layer and includes a resin;

an azo yellow pigment; and a magenta pigment, wherein when a solid image in which a toner applied amount is 4.0 g/m$^2$ is formed, color saturation of the image is 25 to 55, a hue angle is 65° to 95°, and lightness is 50 to 80, and an elemental ratio Mb/Ma between a metal Ma in the metal pigment and a metal Mb in the first coating layer is from 0.08 to 0.20.

2. The brilliant toner according to claim 1, wherein the azo yellow pigment includes at least C.I. Pigment Yellow 74 or C.I. Pigment Yellow 95.

3. The brilliant toner according to claim 1, wherein the magenta pigment is a naphthol magenta pigment or a quinacridone magenta pigment.

4. The brilliant toner according to claim 3, wherein the magenta pigment includes at least C.I. Pigment Red 238 or C.I. Pigment Red 122.

5. The brilliant toner according to claim 1, wherein a weight ratio of the azo yellow pigment and the magenta pigment is 5:1 to 20:1.

6. The brilliant toner according to claim 1, wherein the brilliant pigment has an average circle equivalent diameter larger than an average maximum thickness.

7. The brilliant toner according to claim 1,
wherein the resin is an acrylic resin.

8. A brilliant toner comprising:
a brilliant pigment comprising:
a metal pigment,
a first coating layer that coats a surface of the metal pigment and includes at least one metal oxide selected from the group consisting of silica, alumina, and titania, and
a second coating layer that coats a surface of the first coating layer and includes a resin;
an azo yellow pigment; and
a magenta pigment,
wherein a number average equivalent circular diameter of the brilliant pigment particles is 5 μm to 9 μm,
a content of the brilliant pigment particles having an equivalent circular diameter of 4.0 μm or less with respect to a total number of the brilliant pigment particles is 20% by number or less,
a total amount of the azo yellow pigment and the magenta pigment with respect to 100 parts by weight of the brilliant pigment is 15 parts by weight to 50 parts by weight,
a weight ratio of the azo yellow pigment and the magenta pigment is 3:1 to 30:1, and
an elemental ratio Mb/Ma between a metal Ma in the metal pigment and a metal Mb in the first coating layer is from 0.08 to 0.20.

9. The brilliant toner according to claim 8,
wherein the azo yellow pigment is C.I. Pigment Yellow 74.

10. The brilliant toner according to claim 8,
wherein the magenta pigment is C.I. Pigment Red 238.

11. The brilliant toner according to claim 8,
wherein the brilliant pigment includes aluminum.

12. The brilliant toner according to claim 8, further comprising
a binder resin having a weight average molecular weight of from 15,000 to 300,000.

13. The brilliant toner according to claim 8,
wherein an average circle equivalent diameter D is larger than an average maximum thickness C of the toner.

14. The brilliant toner according to claim 13,
wherein the average maximum thickness C is 1 μm to 6 μm.

15. The brilliant toner according to claim 13,
wherein the average circle equivalent diameter D is 5 μm to 40 μm.

16. An electrostatic charge image developer comprising:
the brilliant toner according to claim 8; and
a carrier.

17. The electrostatic charge image developer according to claim 16,
wherein the carrier is a carrier having a resin coating layer, and
the resin coating layer includes a metal oxide.

* * * * *